US008297611B2

(12) United States Patent
Samoto

(10) Patent No.: US 8,297,611 B2
(45) Date of Patent: Oct. 30, 2012

(54) IMAGE RECORDING APPARATUS

(75) Inventor: Kenji Samoto, Nagoya-shi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 692 days.

(21) Appl. No.: 12/410,433

(22) Filed: Mar. 24, 2009

(65) Prior Publication Data

US 2009/0243209 A1 Oct. 1, 2009

(30) Foreign Application Priority Data

Mar. 31, 2008 (JP) ..... 2008-094081

(51) Int. Cl.
*B65H 3/44* (2006.01)

(52) U.S. Cl. ..... 271/9.07; 271/9.01

(58) Field of Classification Search ..... 271/9.01, 271/9.07, 9.08, 9.11, 9.12, 9.13; 312/107, 312/108, 111; D18/40, 44, 46, 49; 399/107, 399/110, 391

See application file for complete search history.

(56) References Cited

U.S. PATENT DOCUMENTS

| | | | | |
|---|---|---|---|---|
| 3,945,696 | A * | 3/1976 | Yellin | 312/265.2 |
| 5,147,120 | A * | 9/1992 | Ray | 312/111 |
| 7,165,767 | B2 * | 1/2007 | Graef et al. | 271/164 |
| 2002/0031369 | A1 * | 3/2002 | Tokutake et al. | 399/110 |
| 2002/0056962 | A1 * | 5/2002 | Mori | 271/242 |
| 2005/0269917 | A1 * | 12/2005 | Ohayon | 312/108 |
| 2006/0268087 | A1 | 11/2006 | Sasa | |
| 2007/0048058 | A1 | 3/2007 | Koga et al. | |
| 2007/0048059 | A1 | 3/2007 | Asada et al. | |
| 2007/0057447 | A1 | 3/2007 | Asada et al. | |
| 2007/0231044 | A1 | 10/2007 | Koga et al. | |

FOREIGN PATENT DOCUMENTS

| | | | |
|---|---|---|---|
| JP | S59-036039 | A | 2/1984 |
| JP | 4-7223 | * | 1/1992 |
| JP | H07-137850 | A | 5/1995 |

(Continued)

OTHER PUBLICATIONS

Japan Patent Office; Notification of Reason for Refusal in Japanese Patent Application No. 2008-094081 (counterpart to the above-captioned US Patent Application) mailed on Jun. 1, 2010.

*Primary Examiner* — Gerald McClain
*Assistant Examiner* — Thomas Morrison
(74) *Attorney, Agent, or Firm* — Baker Botts L.L.P.

(57) ABSTRACT

An image recording apparatus including first and second bodies that are removably connected to each other. The first body includes (i-a) a pair of first box portions (i-b) a connector interconnecting the first box portions, (i-c) at least one first foot portion provided on a bottom surface of each of the first box portions so as to be in contact with an installed surface, and (i-d) at least one first support portion extending upwardly from the at least one first foot portion. The second body includes (ii-a) a pair of second box portions, (ii-b) a connector interconnecting second box portions, and (ii-c) at least one second foot portion provided on a bottom surface of each of the second box portions. The second foot portion is located in a position aligned with the first support portion, so as to be in contact with a distal end of the first support portion. A sheet conveying device is held by a frame member which bridges between the second box portions.

14 Claims, 17 Drawing Sheets

FOREIGN PATENT DOCUMENTS

| | | | |
|---|---|---|---|
| JP | H10-142868 | A | 5/1998 |
| JP | 2001-233456 | A | 8/2001 |
| JP | 2001-341377 | A | 12/2001 |
| JP | 2002-023440 | A | 1/2002 |
| JP | 2006-326990 | A | 12/2006 |
| JP | 2007-090761 | A | 4/2007 |

* cited by examiner

IMAGE RECORDING APPARATUS

CROSS REFERENCE TO RELATED APPLICATION

This application claims priority from Japanese Patent Application No. 2008-094081 filed on Mar. 31, 2008, the disclosure of which is herein incorporated by reference in its entirety.

BACKGROUND OF THE INVENTION

1. Field of the Invention

The present invention relates to an image recording apparatus having first and second bodies that are removably connected to each other such that the second body is disposed on an upper side of the first body wherein the second body is provided with components configured to perform at least one common function that is common to a plurality of types of image recording apparatuses while the first body is provided with components configured to perform at least one additional function that is other than the above-described at least one common function.

2. Discussion of Related Art

In an image recording apparatus such as an inkjet printer, ink droplets are ejected from a recording head toward each recording sheet that is conveyed along a conveying path whereby an image is recorded on each recording sheet.

JP-2007-90761A discloses an image recording apparatus including a lower unit and an upper unit which is disposed on an upper side of the lower unit. The upper unit has an inner space for accommodating therein a first sheet supplying cassette that is configured to hold recording sheets. With the first sheet supplying cassette being accommodated in the inner space of the upper unit, the recording sheets held by the first sheet supplying cassette are supplied to a conveying path that is defined in the upper unit. A recording head is provided to face the conveying path, and is reciprocably movable in a direction perpendicular to a conveying direction in which the recording sheets are to be conveyed. The recording head is operated to eject ink droplets toward each recording sheet while the recording sheet is being conveyed along the conveying path whereby an image is recorded on the recording sheet. After the image has been recorded on the recording sheet, the recording sheet is discharged onto the first sheet supplying cassette. The lower unit has an inner space for accommodating therein a second sheet supplying cassette that is also configured to hold recording sheets. With the second sheet supplying cassette being accommodated on the inner space of the lower unit, the recording sheets held by the second sheet supplying cassette are supplied to the conveying path that is defined in the upper unit. Each recording sheet supplied from the second sheet supplying cassette is subjected to an image recording operation performed by the recording head, in the same manner as each recording sheet supplied from the first sheet supplying cassette.

JP-2002-23440A discloses an image forming apparatus of electrophotographic type. Right and left foot portions are provided on a bottom plate of a main body of the apparatus in which a plurality of photosensitive drums are disposed. The right and left foot portions are in contact with an installed surface on which the apparatus is installed, so as to support the main body of the apparatus. A pair of rockable blocks are provided in the right and left foot portions, respectively, so as to be rockably supported by the respective foot portions. The pair of rockable blocks are connected to each other through an linkage plate so as to be movable together with each other.

Each of the rockable blocks includes a downwardly projecting portion projecting downwardly through an opening that is formed through a bottom surface of a corresponding one of the right and left foot portions. Each of the rockable blocks has a contact surface which is located on a lower side of the corresponding foot portion and which is to be in contact with the installed surface. Where the installed surface (on which the apparatus is installed) has protrusions and recesses, the rockable blocks are rocked depending on such an irregularity of the surface, so that the main body of the apparatus is supported by the rockable blocks even if being somewhat tilted. That is, the protrusions and recesses of the installed surface are absorbed by the rockable blocks, whereby the main body of the apparatus can be prevented from being twisted. It is therefore possible to prevent disalignment between components of the apparatus such as the photosensitive drums and a scanner.

JP-2001-341377A discloses an image forming apparatus in which first and second foot portions are provided on a bottom surface of a main body of the apparatus. Each of the first and second foot portions has an inverted truncated cone shape. The first foot portion is made of rubber while the second foot portion is made of metal. The first foot portion protrudes downwardly from the bottom surface of the main body by a distance larger than a distance by which the second foot portion protrudes downwardly from the bottom surface of the main body. Therefore, the second foot portion can be prevented from being deformed by shock applied thereto upon installation of the apparatus. Further, since the second foot portion is made of metal while the first foot portion is made of rubber, it is possible to prevent the main body of the apparatus from being tilted by deformation of the first foot portion. This feature is effective to prevent problems such as jamming or inclined conveying of recording sheet which could be caused by tilting of the main body of the apparatus.

The image recording apparatus disclosed in JP-2007-90761A has small height and light weight, and is integrally formed of resin so as to be manufacturable at low cost. Further, since the inner spaces are defined in the respective upper and lower units, a body of each of the upper and lower units has a low rigidity and can be easily distorted thereby causing various problems. For example, the distortion of the body of the upper unit could reduce positional accuracy of a roller for conveying the recording sheets along the conveying path and positional accuracy of guide rails (guide rods) for slidably supporting a carriage carrying the recording head. The reduction of the positional accuracy of the roller could cause inclined conveying of the recording sheet. The reduction of the positional accuracy of the guide rails could affect quality of image recorded on each of the recording sheets. Further, the distortion of the body of the lower unit could make it impossible to reliably supply the recording sheets held by the second sheet supplying cassette, toward the conveying path. For solving such problems, it might be possible that the body of each of the upper and lower units is constituted by a frame made of steel or other metallic material. Where the body of each of the upper and lower units is constituted by the frame, the distortion of the body might be prevented by a certain degree. However, such a modification could cause other problems such as increase of weight of the apparatus and increase of manufacturing cost of the apparatus.

In these days, various types of image recording apparatuses are manufactured by manufacturers, for satisfying various needs of users. To this end, in the image recording apparatus disclosed in JP-2007-90761A, the upper unit constructed to perform common functions common to a plurality of types of image recording apparatuses and the lower unit constructed to supply the recording sheets from the second sheet supplying cassette toward the recording head are removably connected to each other, so that an image recording apparatus provided by only the upper unit as well as the image recording apparatus provided by the upper and lower units is manufactured as a product. That is, there is a case where the upper unit is used in the apparatus provided by only the upper unit and also a case where the upper unit is used in the apparatus provided by the upper and lower units. Therefore, each component of the upper unit has to be provided with a certain degree of positional accuracy where the apparatus is provided by only the upper unit, and each component of the upper and lower units has to be provided with a certain degree of positional accuracy where the apparatus is provided by the upper and lower units that are connected to each other.

SUMMARY OF THE INVENTION

The present invention was made in view of the background prior art discussed above. It is therefore an object of the invention to provide an image recording apparatus having first and second bodies removably connected to each other and capable of maintaining positional accuracy of each component of the apparatus irrespective of whether the first and second bodies are connected to each other or not.

This object may be achieved according to a principle of the invention, which provides an image recording apparatus including: (A) a conveying device configured to convey sheets supplied from first and second sheet holders, in a conveying direction along a conveying path; and (B) first and second bodies that are removably connected to each other such that the second body is disposed on an upper side of the first body. The first body includes (i-a) a pair of first box portions which are opposed to each other in an opposed direction and which cooperate with each other to define a first space therebetween, such that the first sheet holder can be accommodated in the first space, (i-b) a first connector interconnecting the pair of first box portions, (i-c) at least one first foot portion provided on a bottom surface of each of the first box portions so as to be in contact with an installed surface on which the image recording apparatus is to be installed, and (i-d) at least one first support portion extending upwardly from the at least one first foot portion. The second body includes (ii-a) a pair of second box portions which are mounted on the pair of first box portions, respectively, the pair of second box portions being opposed to each other in the opposed direction and cooperating with each other to define a second space therebetween, such that the second sheet holder can be accommodated in the second space, (ii-b) a second connector interconnecting the pair of second box portions, and (ii-c) at least one second foot portion provided on a bottom surface of each of the second box portions, the at least one second foot portion being located in a position aligned with the at least one first support portion, so as to be in contact with a distal end of the at least one first support portion. The image recording apparatus further includes a frame member extending in the opposed direction and bridging between the pair of second box portions, such that the conveying device is held by the frame member.

In the image recording apparatus constructed according to the invention, the first and second bodies are connected to each other in such a manner that permits the two bodies to be removed from each other, for enabling one of the two bodies to constitute the image recording apparatus even without the other of the two bodies. For example, the second body may be provided with components configured to perform at least one common function that is common to a plurality of types of image recording apparatuses while the first body may be provided with components configured to perform at least one additional function that is other than the above-described at least one common function.

In the image recording apparatus according to the invention, the first body includes the pair of first box portions which are opposed to each other in the opposed direction with a certain distance therebetween and which are connected to each other through the first connector, such that the first sheet holder can be accommodated in the first space that is defined by the pair of first box portions or by cooperation of the pair of first box portions and the first connector. Since the first space is provided between the pair of first box portions, the first body could easily suffer from distortion. However, in a state in which the first body is connected to the second body, the second box portions are mounted on the first box portions, respectively, so that the first box portions receive weight of the second body through the at least one first support portion. Thus, owing to the weight of the second body acting on the first box portions, a shape of each of the first box portions is stabilized. That is, owing to the weight of the second body, the shape of each of the first box portions can be stabilized without depending on strength of connection of each of the first box portions with the other of the first box portions. It is therefore possible to maintain a certain degree of positional accuracy of each of the first box portions, even without a frame member interconnecting the first box portions.

Further, in the image recording apparatus according to the invention, the second body includes the pair of second box portions which are opposed to each other in the opposed direction with a certain distance therebetween and which are connected to each other through the second connector and the frame member, such that the second sheet holder can be accommodated in the second space that is defined by the pair of second box portions or by cooperation of the pair of second box portions and the second connector. Since the second space is provided between the pair of second box portions, the second body could easily suffer from distortion. However, in a state in which the first body is removed from the second body for use of the image recording apparatus without the first body, the weight of the second body is transmitted onto the installed surface via the at least one second foot portion. Further, in a state in which the second body is connected to the first body, each of the second box portions is supported by the at least one first support portion projecting upwardly from the at least one first foot portion that is provided on the bottom surface of a corresponding one of the first box portions, so that the weight of the second body is vertically straight transmitted onto the installed surface, via the at least one second foot portion, the at least one first support portion and the at least one first foot portion. Owing to the transmission of the weight of the second body onto the installed surface, a shape of each of the second box portions is stabilized. That is, the shape of each of the second box portions can be stabilized without depending on strength of connection of each of the second box portions with the other of the second box portions, irrespective of whether the first and second bodies are connected to each other or not. Since the conveying device is held by the frame member that bridges between the second box portions whose shape is stabilized, it is possible to maintain a certain degree of positional accuracy of the conveying device, irrespective of whether the first and second bodies are connected to each other or not. Thus, the positional accuracy of each component of the apparatus can be maintained irrespective of whether the first and second bodies are connected to each other or not.

According to one preferred form of the invention, the above-described at least one first foot portion consists of at least three first foot portions provided on the bottom surface of each of the first box portions so as to be in contact with the installed surface, wherein the above-described at least one first support portion consists of at least three first support portions each extending upwardly from a corresponding one of the at least three first foot portions, and wherein the above-described at least one second foot portion consists of at least three second foot portions provided on the bottom surface of each of the second box portions, such that each of the at least three second foot portions is located in a position that is aligned with a corresponding one of the at least three first support portions, so as to be in contact with a distal end of the corresponding one of the at least three first support portions.

In the image recording apparatus according to one preferred form of the invention, the at least three first foot portions are provided on the bottom surface of each of the first box portions, so that the shape of each of the first box portions is further stabilized owing to the at least three first foot portions that are in contact with the installed surface. That is, owing to the at least three first foot portions, the shape of each of the first box portions can be stabilized without depending on the strength of the connection of each of the first box portions with the other of the first box portions. It is noted that the at least three first foot portions are preferably located in respective positions which are distant from one another and which do not lie on a single straight line.

Further, in the image recording apparatus according to one preferred form of the invention, the at least three second foot portions are provided on the bottom surface of each of the second box portions, and are located in respective positions aligned with the at least three first support portions that extend upwardly from the at least three first foot portions, so that the shape of each of the second box portions is further stabilized owing to the at least three second foot portions, each of which is in contact with the distal end of a corresponding one of the at least three first support portions in the state in which the second body is connected to the first body, and each of which is in contact with the installed surface in the state in which the first body is removed from the second body for use of the image recording apparatus without the first body. That is, owing to the at least three second foot portions, the shape of each of the second box portions can be further stabilized without depending on the strength of the connection of each of the second box portions with the other of the second box portions, irrespective of whether the first and second bodies are connected to each other or not. It is noted that the at least three second foot portions are preferably located in respective positions which are distant from one another and which do not lie on a single straight line.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENTS

<Multifunction Apparatus>

Figure 1:
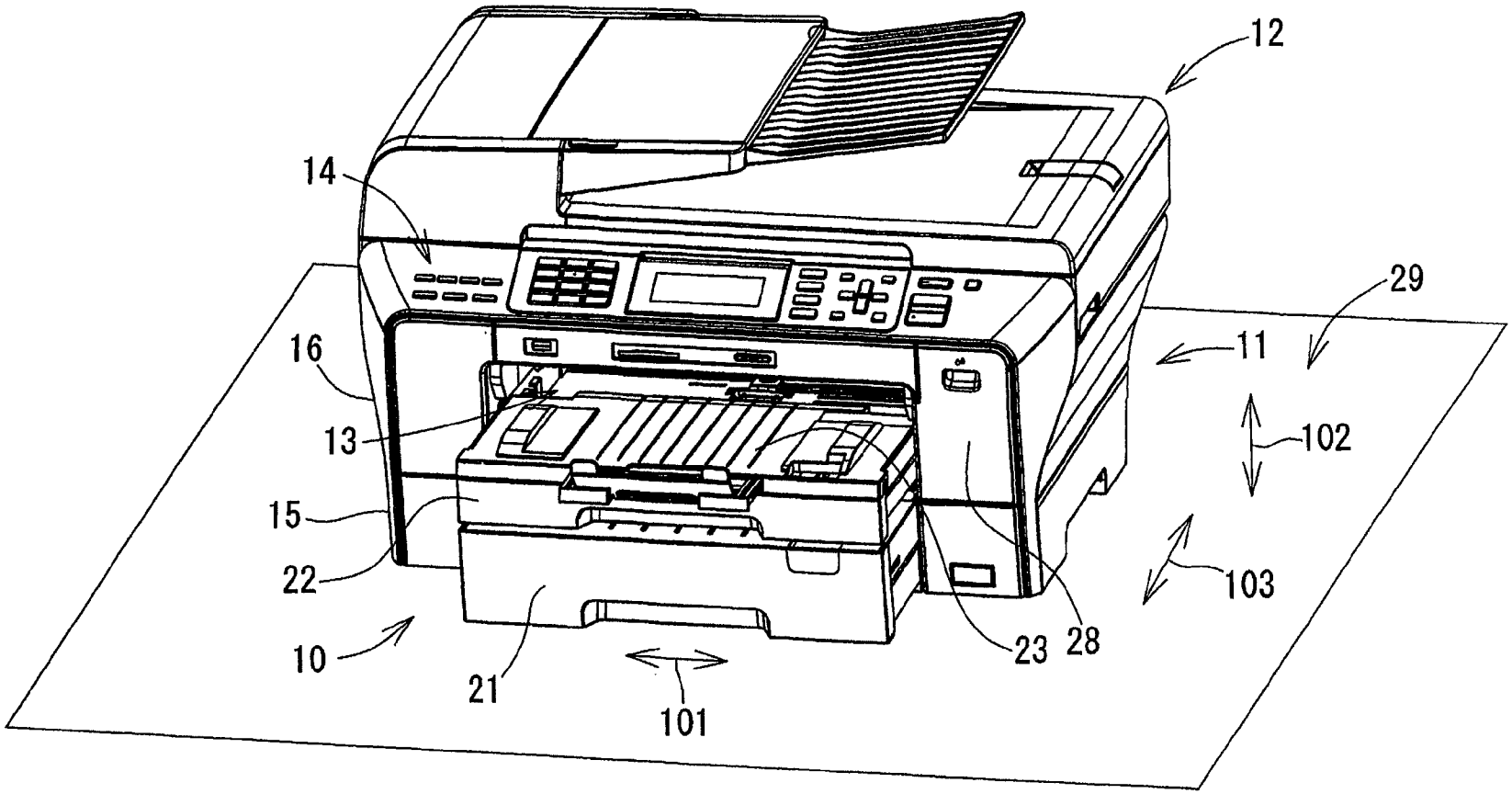
FIG. 1 is a perspective view showing a multifunction apparatus 10 constructed according to an embodiment of the invention.

FIG. 1 shows an image recording apparatus in the form of a multifunction apparatus 10 that is constructed according to an embodiment of the invention. The multifunction apparatus 10 includes a printer 11 and a scanner 12 that are integral with each other, so as to have printer, scanner, copier and facsimile functions. The multifunction apparatus 10 is used while being installed on an installed surface 29 that is a horizontal and flat surface. It is noted that the image recording apparatus according to the invention does not necessarily have to be provided by the multifunction apparatus 10 including the scanner 12 in addition to the printer 11, but may be provided by a single function apparatus not having the scanner and facsimile functions.

As shown in FIG. 1, the multifunction apparatus 10 has a generally rectangular parallelepiped shape as a whole. Specifically, the apparatus 10 has width and depth dimensions as measured in width and depth directions 101, 103, respectively, and a height dimension as measured in a vertical direction 102 that is smaller than the width and depth dimensions. The scanner 12 is provided by an upper portion of the apparatus 10 while the printer 11 is provided by a lower portion of the apparatus 10. The scanner 12 is configured to read an image carried on an original. The printer 11 is connected mainly to an external information device (not shown) such as computer, and is configured to record an image on a recording sheet, based on print data transmitted from the external information device or based on image data representing the image read by the scanner 12. The scanner 12 may have any construction that will not be described herein.

An operator's control panel 14 is provided on a front upper portion of the multifunction apparatus 10, and has various keys and a display. The various keys are manually operable by an operator of the apparatus 10 to input various command signals for various operations to be performed by the apparatus 10. The display is provided for indicating a message and an image to provide the operator with information. It is noted that the apparatus 10 is operable not only in response to the command manually inputted through the operator's control panel 14 but also in response to the command transmitted from the external information device through a printer driver and a scanner driver that are installed in the computer.

The printer 11 is constituted by a lower unit 15 and an upper unit 16, which are connected to each other such that the upper unit 16 is disposed on an upper side of the lower unit 15. An opening 13 is provided in a front portion of the printer 11, so that a second sheet supplying cassette 22 as a second sheet holder can be introduced into the upper unit 16 via the opening 12, while a first sheet supplying cassette 21 as a first sheet holder can be introduced into the lower unit 15 via the opening 12. Each of the first and second sheet supplying cassettes 21, 22 is provided for holding rectangular-shaped recording sheets of legal size, so that the recording sheets can be supplied from the first and second sheet supplying cassettes 21, 22 toward the upper unit 16. After being subjected to a recording operation performed by an image recording device 40 (see FIG. 2) that is provided in the upper unit 16, each of the recording sheets is discharged onto an upper surface 23 of the second sheet supplying cassette 22 which serves as a sheet exit tray.

<Printer>

Figure 2:
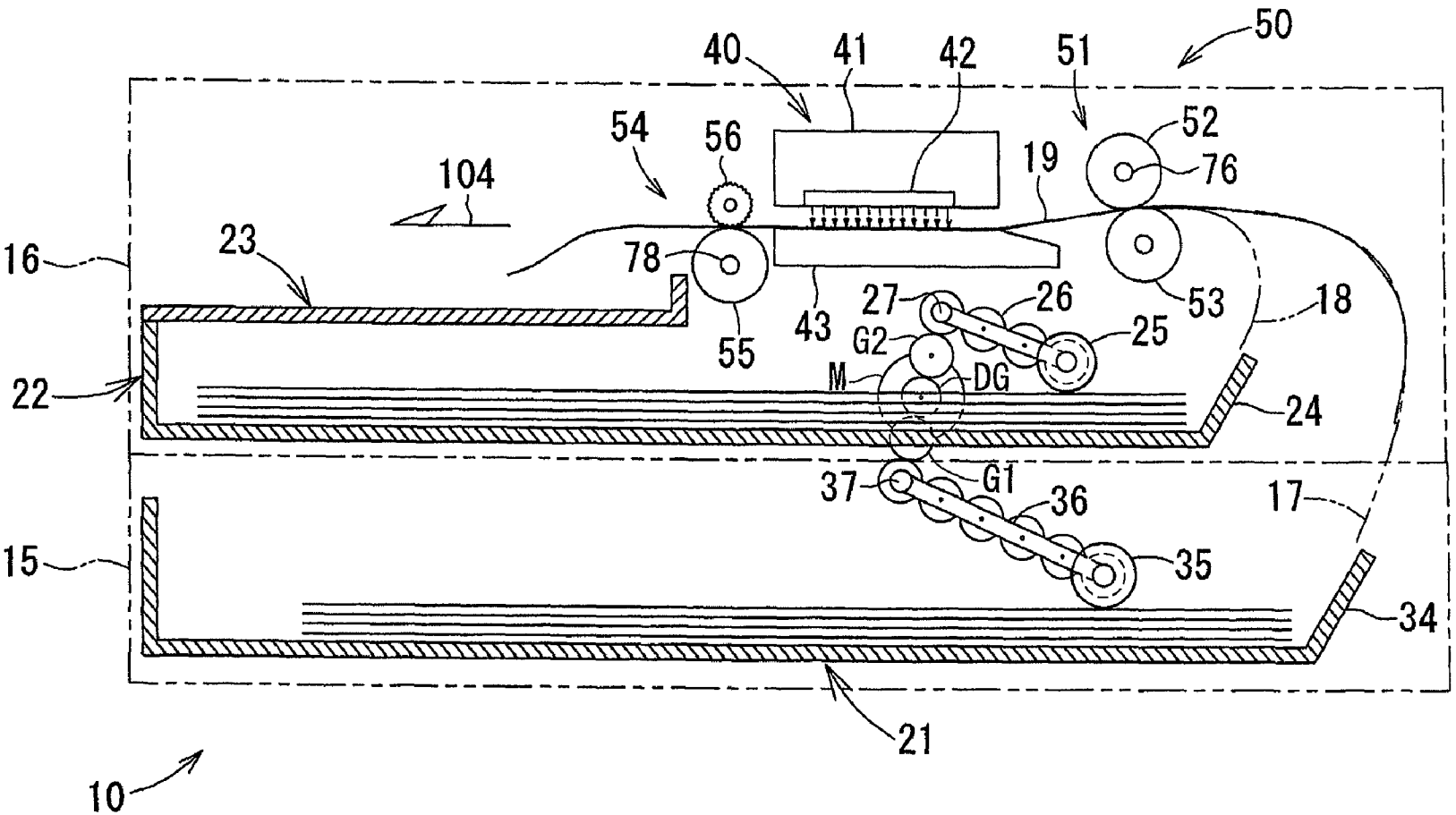
FIG. 2 is a view schematically showing an internal construction of a printer 11 that is incorporated in the multifunction apparatus 10.

The second sheet supplying cassette 22 has a vessel-like shape with an opening that opens in its rear portion, i.e., a right-side portion as seen in FIG. 2, so that the recording sheets can be introduced via the opening so as to be stacked in the cassette 22. The second sheet supplying cassette 22 is capable of accommodating or holding the recording sheets of various sizes such as A3, A4, B5 and postal sizes. The upper surface 23 of the second sheet supplying cassette 22 is provided on a front portion of the multifunction apparatus 10, i.e., a left-side portion of the apparatus 10 as seen in FIG. 2.

The first sheet supplying cassette 21 has a vessel-like shape with an opening that opens in its rear portion, i.e., a right-side portion as seen in FIG. 2, so that the recording sheets can be introduced via the opening so as to be stacked in the cassette 21. The first sheet supplying cassette 21 is capable of accommodating or holding the recording sheets of various sizes such as A3, A4, B5 and postal sizes. Where the recording sheets held in the first sheet supplying cassette 21 are different in size or type from those held in the second sheet supplying cassette 22, two different sizes or types of recording sheets can be selectively subjected to image recording operations, without necessity of changing the recording sheets held in the first sheet supplying cassette 21 or second sheet supplying cassette 22.

When the second sheet supplying cassette 22 is received in the upper unit 16, a slant plate 24 of the second sheet supplying cassette 22 is positioned below a curved conveying path 18 that is defined in the upper unit 16, and a sheet supplying roller 25 is positioned on an upper side of the second sheet supplying cassette 22, as shown in FIG. 2. The sheet supplying roller 25 is rotatably held by a distal end portion of an arm 26, which is connected to a body 32 (see FIG. 9) of the upper unit 16. The arm 26 is pivotably held by a shaft 27 that is fixed to the body 32 of the upper unit 16, and is biased downwardly toward the second sheet supplying cassette 22 by its own weight or an elastic force generated by a spring or the like. A motor M is fixedly provided in the body 32 of the upper unit 16, so as to serve as a drive source that is operable to rotate the sheet supplying roller 25 and a sheet supplying roller 35 that is described below. A drive force generated by the motor M is transmitted to the sheet supplying roller 25 via a drive transmission mechanism in the form of a plurality of gears, so that the sheet supplying roller 25 is rotated by the drive force of the motor M. The plurality of gears, specifically described, consist of a drive gear DG fixedly mounted on a drive shaft of the motor M, a driven gear coaxial with the sheet supplying roller 25, and gears interconnecting the drive gear DG and the driven gear. In the present embodiment, the interconnecting gears consist of three gears held by the arm 26 and one gear G2 interconnecting the drive gear DG and the three gears held by the arm 26. When the sheet supplying roller 25 is rotated with the roller 25 being held in contact with an uppermost one of the recording sheets held in the second sheet supplying cassette 22, the uppermost one of the recording sheets is moved along the slant plate 24 so as to be supplied toward the conveying paths 18, 19.

When the first sheet supplying cassette 21 is received in the lower unit 15, a slant plate 34 of the first sheet supplying cassette 21 is positioned below a curved conveying path 17 that is defined by cooperation of the upper and lower units 16, 15, and the sheet supplying roller 35 is positioned on an upper side of the first sheet supplying cassette 21, as shown in FIG. 2. The sheet supplying roller 35 is rotatably held by a distal end portion of an arm 36, which is connected to a body 31 (see FIG. 14) of the lower unit 15. The arm 36 is pivotably held by a shaft 37 that is fixed to the body 31 of the lower unit 15, and is biased downwardly toward the first sheet supplying cassette 21 by its own weight or an elastic force generated by a spring or the like. The drive force generated by the motor M is transmitted to the sheet supplying roller 35 via a drive transmission mechanism in the form of a plurality of gears, so that the sheet supplying roller 35 is rotated by the drive force of the motor M. The plurality of gears, specifically described, consist of the above-described drive gear DG fixedly mounted on the drive shaft of the motor M, a driven gear coaxial with the sheet supplying roller 35, and gears interconnecting the drive gear DG and the driven gear. In the present embodiment, the interconnecting gears consist of five gears held by the arm 36 and one gear G1 interconnecting the drive gear DG and the five gears held by the arm 36. The interconnecting gear G1 as well as the drive gear DG and the interconnecting gear G2 is held by the body 32 of the upper unit 16, while the above-described five gears and the driven gear (coaxial with the roller 35) are held by the body 31 of the lower unit 15 through the arm 36. When the sheet supplying roller 35 is rotated with the roller 35 being held in contact with an uppermost one of the recording sheets held in the first sheet supplying cassette 21, the uppermost one of the recording sheets is moved along the slant plate 34 so as to be supplied toward the conveying paths 17, 19. It is noted that first and second bodies of the multifunction apparatus 10 are provided by the bodies 31, 32 of the upper and lower units 16, 15, respectively. It is also noted that the sheet supplying roller 35 cooperates with a drive transmission (configured to transmit the drive force of the motor M to the roller 35) to constitute a sheet supplying device. It is further noted that teeth of each of the gears (such as the gears DG, G1, G2) are not illustrated in FIG. 2. In the present embodiment, the drive transmission is provided by the above-described five gears and the driven gear that is coaxial with the roller 35.

After being conveyed along the conveying path 17 or conveying path 18, the recording sheets are conveyed along the conveying path 19 which is defined in the upper unit 16 and which is contiguous to the conveying paths 17, 18. The conveying path 19 extends in a forward direction (i.e., leftward direction as seen in FIG. 2) from a junction of the conveying paths 17, 18, to a position located above the upper surface 23 of the second sheet supplying cassette 22. The drive force of the motor M that is held by the upper unit 16 is transmitted to one of the sheet supply rollers 35, 25 which is selected by a selector mechanism (not shown), so that the recording sheets are supplied to the conveying path 19 from a selected one of the first and second sheet supplying cassettes 21, 22.

Figure 3:
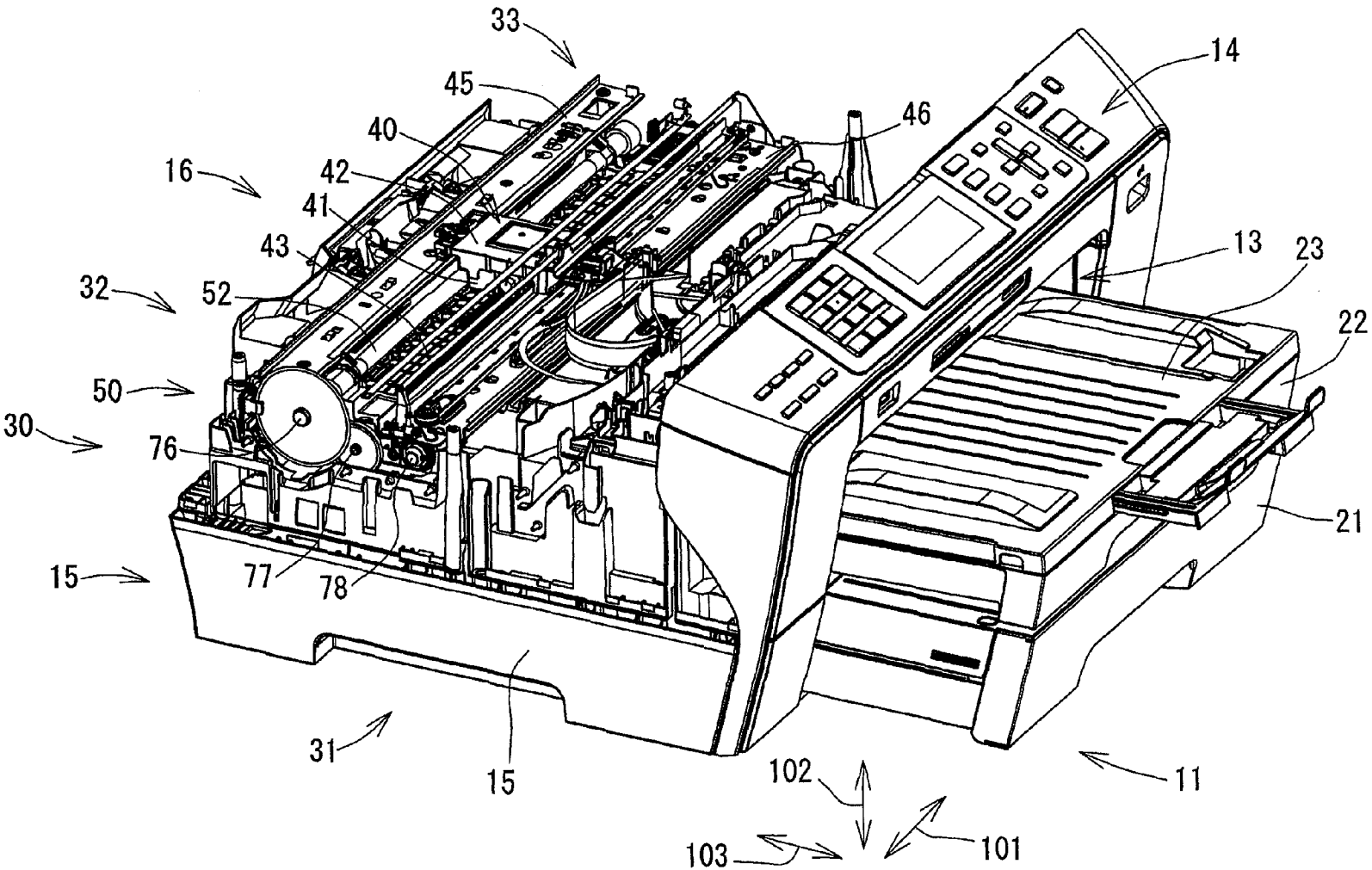
FIG. 3 is a perspective view showing the internal construction of the printer 11.

As shown in FIGS. 2 and 3, a platen 43 is provided on the conveying path 43, so that each recording sheet that is being conveyed along the conveying path 19 is supported from its lower side by the platen 43. The image recording device 40 is provided on an upper side of the platen 43. The image recording device 40 and the platen 43 are opposed to each other with a certain distance therebetween. Each recording sheet is subjected to the recording operation performed by the image recording device 40, when passing over the platen 43.

<Conveying Device>

A conveying device 50 is provided on the conveying path 19, and is configured to convey each recording sheet (which has been supplied from the second sheet supplying cassette 22 via the conveying path 18 or from the first sheet supplying cassette 21 via the conveying path 17) along the conveying path 19. The conveying device 50 includes a set of conveying rollers 51 and a set of discharging rollers 54.

The set of conveying rollers 51 is disposed on an upstream side of the image recording device 40 in a conveying direction 104 in which each recording sheet is to be conveyed along the conveying path 19. The conveying direction 104 is perpendicular to the width direction 101 that is perpendicular to a drawing sheet of FIG. 2. The set of conveying rollers 51 consists of a conveying roller 52 and a pinch roller 53. The conveying roller 52, which serves as a first roller, and is rotated by a drive force that is transmitted from a LF motor (not shown) via a drive transmission mechanism 90 (see FIG. 5). The pinch roller 53 is freely rotatably disposed on a lower side of the conveying roller 52, and is biased in a direction toward the conveying roller 52 by a spring so as to be held in pressing contact with the conveying roller 52. When the recording sheet enters between the conveying roller 52 and pinch roller 53, the pinch roller 53 is displaced in a direction away from the conveying roller 52. Since the pinch roller 53 is biased by the spring in the direction toward the conveying roller 52, a rotational force is reliably transmitted from the conveying roller 52 to the recording sheet that is gripped between the rollers 52, 53. The conveying paths 17, 18 merge into the conveying path 19 on an upstream side of the conveying roller 52 in the conveying direction 104, so that each recording sheet enters the conveying path 19 before reaching the conveying roller 52, irrespective of whether the recording sheet has been conveyed along the conveying path 17 or conveying path 18. Thus, the recording sheets conveyed along either of the conveying paths 17, 18 are conveyed onto the platen 43 by rotation of the conveying roller 52, while being gripped between the conveying roller 52 and pinch roller 53.

The set of discharging rollers 54 is disposed on a downstream side of the image recording device 40 in the conveying direction 104. Thus, the set of discharging rollers 54 is located on a downstream side of the set of conveying rollers 51 in the conveying direction 104. The set of discharging rollers 54 consists of a discharging roller 55 and a spur roller (rowel) 56. The discharging roller 55, which serves as a second roller, and is rotated by the drive force that is transmitted from the LF motor (not shown) via the drive transmission mechanism 90 (see FIG. 5). The spur roller 56 is freely rotatably disposed on an upper side of the discharging roller 55, and is biased in a direction toward the discharging roller 55 by a spring so as to be held in pressing contact with the discharging roller 55. When the recording sheet enters between the discharging roller 55 and the spur roller 56, the spur roller 56 is displaced in a direction away from the discharging roller 55. Since the spur roller 56 is biased by the spring in the direction toward the discharging roller 55, a rotational force is reliably transmitted from the discharging roller 55 to the recording sheet that is gripped between the rollers 55, 56.

Figure 5:
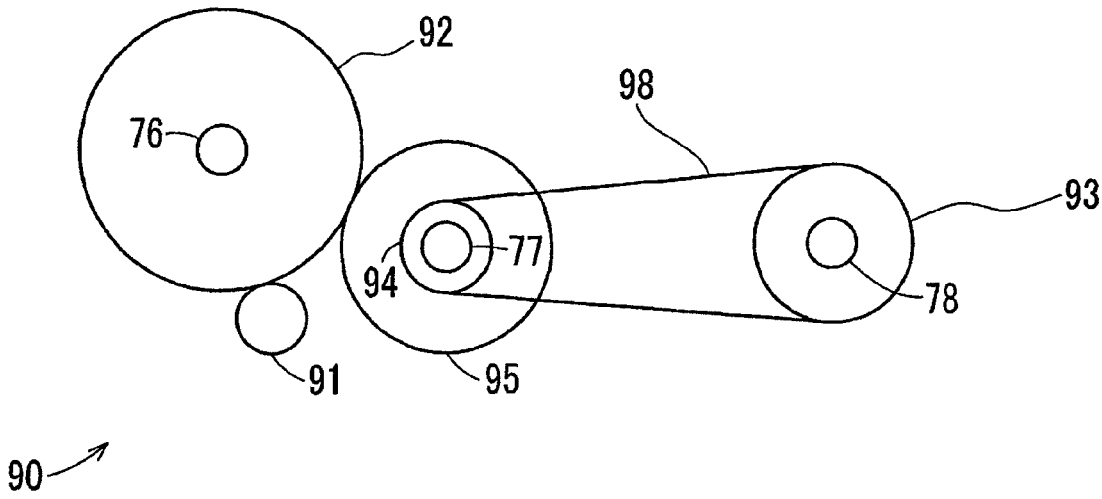
FIG. 5 is a view schematically showing a drive transmission mechanism 90 that is included in the printer 11.

The drive transmission mechanism 90 is configured to transmit the drive force of the LF motor (not shown) to the conveying roller 52 and the discharging roller 55. As shown in FIG. 5, the drive transmission mechanism 90 includes a motor gear 91, a driven gear 92, an intermediate gear 95, a small-diameter pulley 94, a belt 98 and a large-diameter pulley 93. It is noted that, in FIG. 5, the conveying rollers 52 and the discharging roller 55 are not illustrated. Further, although each of the above-described gears 91, 92, 95, pulleys 94, 93 and belt 98 has teeth formed in its outer or inner circumferential surface, the teeth are not illustrated in FIG. 5.

The motor gear 91 is fixedly mounted on a drive shaft of the LF motor. The driven gear 92 is fixedly mounted on a shaft 76 (see FIG. 4) of the conveying roller 52, so as to be rotatable together with the conveying roller 52. The driven roller 92 meshes with the motor gear 91 and also with the intermediate gear 95 which is disposed in proximity with the driven roller 92 and which is fixedly mounted on a shaft 77 (see FIG. 4). The large-diameter pulley 93 is fixedly mounted on a shaft 78 (see FIG. 4) of the discharging roller 55, so as to be rotatable together with the discharge roller 55. Meanwhile, the small-diameter pulley 94 is fixedly mounted on the shaft 77, so as to be rotatable together with the intermediate gear 95. The belt 98 is stretched around the two pulleys 93, 94 so as to interconnect the two pulleys 93, 94. The belt 98 is provided by an endless belt having teeth that are formed in its inner circumferential surface.

When the drive force is transmitted to the motor gear 91 from the LF motor, the drive force is transmitted to the driven gear 92 whereby the conveying roller 52 (see FIG. 2) is rotated. The drive force transmitted to the driven gear 92 is then transmitted to the large-diameter pulley 93 via the intermediate gear 95, small-diameter pulley 94 and belt 98, whereby the discharging roller 55 (see FIG. 2) is rotated. That is, the conveying roller 52 and the discharging roller 55 are rotated in synchronization with each other, by the drive force transmitted thereto. Thus, the rotation of the conveying roller 52 and the rotation of the discharging roller 55 are synchronized with each other, so that the discharging roller 55 and the spur roller 56 are rotated concurrently with the rotation of the conveying roller 52 and the pinch roller 53. Each recording sheet supplied to the conveying path 19 is conveyed onto the platen 43, while being gripped between the conveying roller 52 and the pinch roller 53. When the recording sheet reaches the pair of discharging rollers 54, the recording sheet is gripped between the discharging roller 55 and the spur roller 56 and is discharged onto the upper surface 23 of the second sheet supplying cassette 22. Thus, each recording sheet conveyed by the conveying device 50 is eventually discharged onto the upper surface 23 of the second sheet supplying cassette 22.

Figure 4:
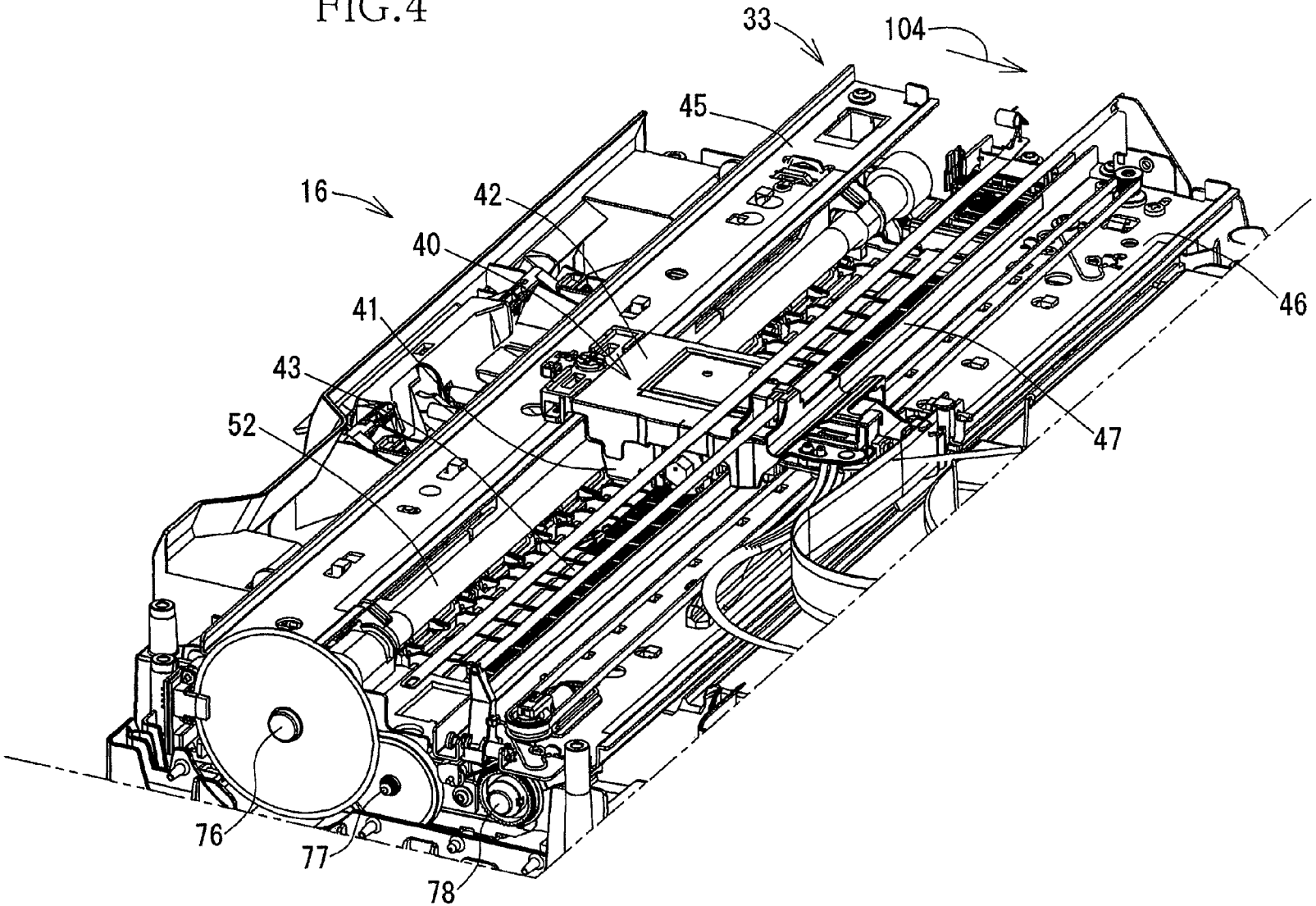
FIG. 4 is a view showing, in enlargement, a part of FIG. 3.

As shown in FIGS. 2 to 4, the image recording device 40 is disposed between the conveying roller 52 and the discharging roller 55. The image recording device 40 includes an inkjet recording head 42 and a carriage 41 carrying the recording head 42. The carriage 41 is reciprocably movable in the width direction 101 of the printer 11 (i.e., direction perpendicular to drawing sheet of FIG. 2). As shown in FIG. 2, the recording head 42 has nozzles opening in its lower surface. An ink is supplied to the recording head 42 from an ink cartridge (not shown) that is disposed inside the printer 11. While the carriage 41 is being moved, the recording head 42 ejects the ink in the form small ink droplets through selected ones of the nozzles toward the platen 43, whereby an image is formed on the recording sheet that is being conveyed over the platen 43.

<Frame Member>

Figure 6:
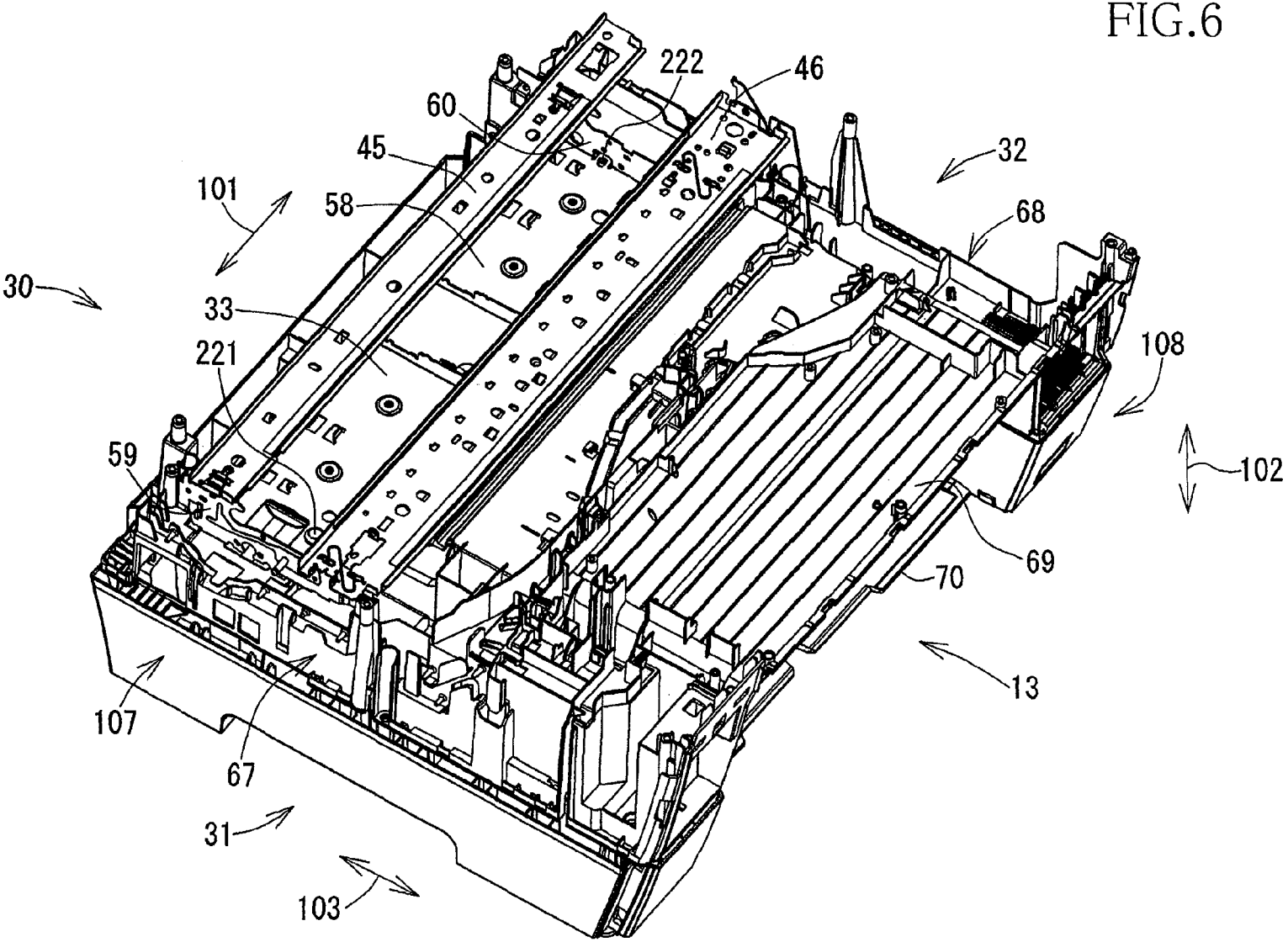
FIG. 6 is a perspective view showing a main body 30 of the printer 11.
Figure 7:
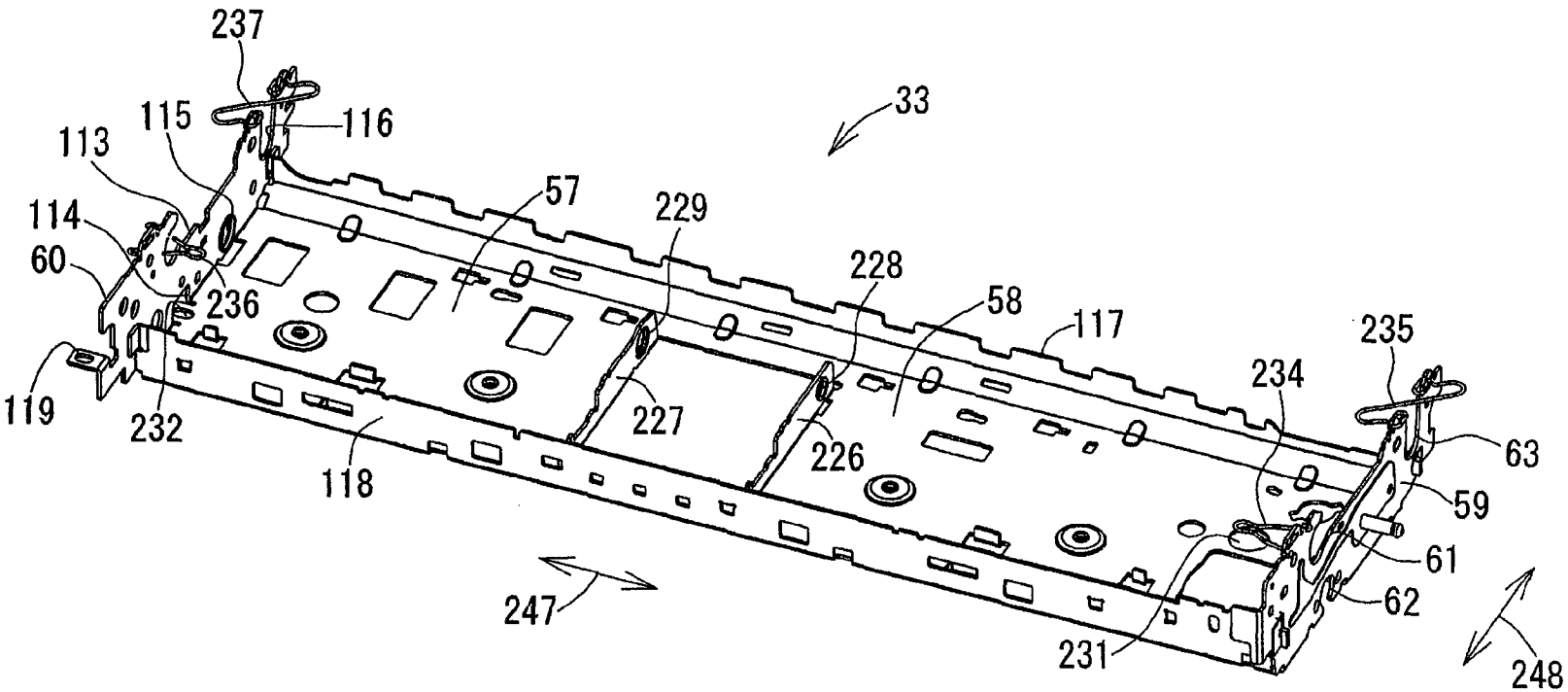
FIG. 7 is a perspective view showing a frame member 33 that is included in the printer 11.
Figure 8:
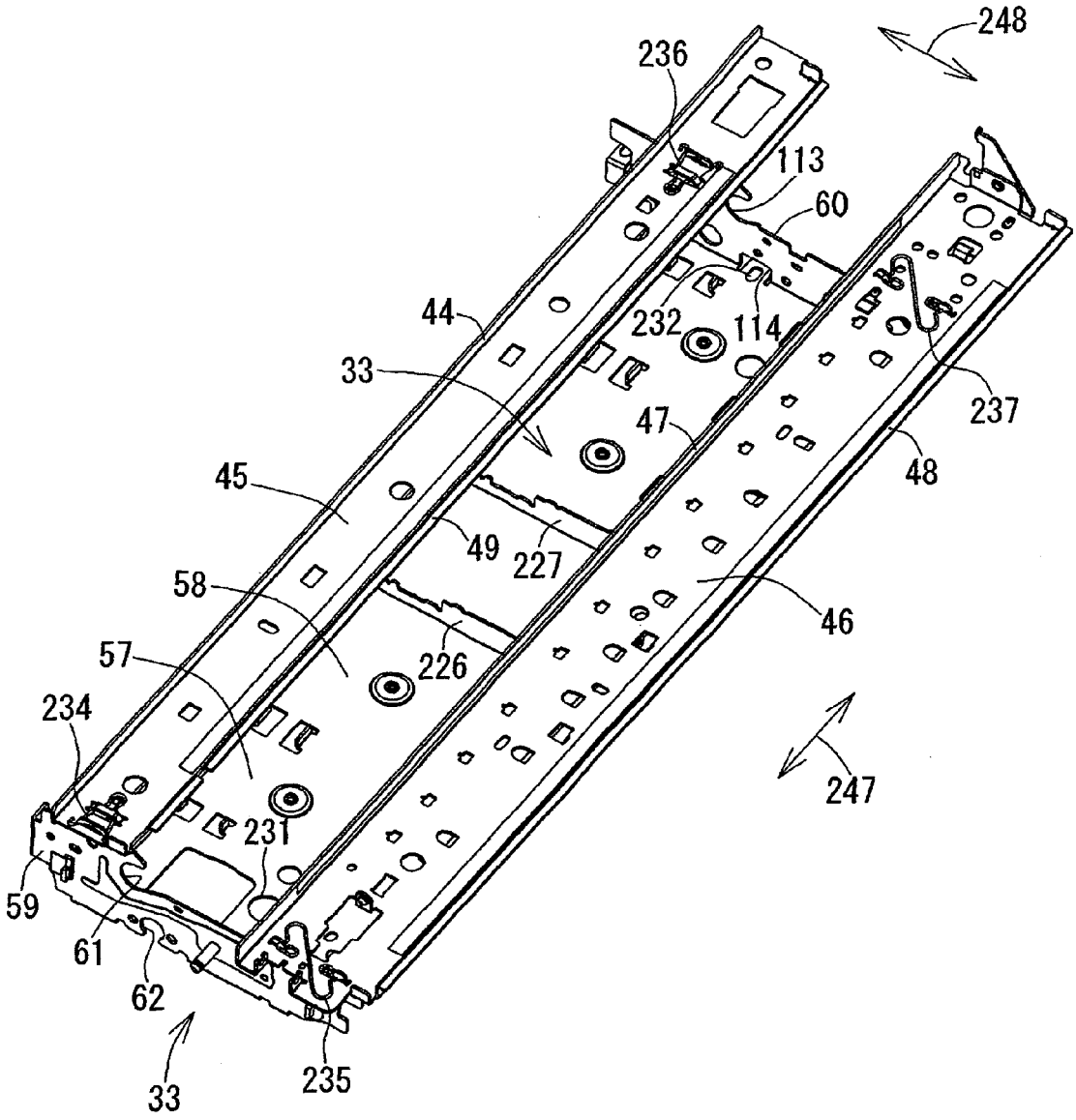
FIG. 8 is a perspective view showing a pair of guide rails 45, 46 that are supported by the frame member 33.

As shown in FIGS. 6 and 8, a frame member 33 is provided in the body 32 of the upper unit 16, and holds the conveying device 50, image recording device 40 and guide rails 45, 46. As shown in FIG. 7, the frame member 33 is provided by, for example, a thin steel plate, and includes a bottom plate portion 58 and a pair of side plate portions 59, 60 that are bent relative to the bottom plate portion 58. The bottom plate portion 58 includes end portions 117, 118 which are opposite to each other in its width direction, and which are bent relative to a main body 57 of the bottom plate portion 58, for avoiding the bottom plate portion 58 from being easily deflected. The bottom plate portion 58 has through-holes 231, 232, into which protrusions 221, 222 (see FIG. 6) are to be introduced when the frame member 33 is fixed to the body 32 of the upper unit 16. The main body 57 of the bottom plate portion 58 has a pair of bent portions 226, 227 that are perpendicularly bent. The bent portions 226, 227 have respective receiver holes 228, 229 into which the shaft 77 of the intermediate gear 95 is to be received.

As shown in FIG. 7, the side plate portion 59 is provided on a side of the bottom plate portion 58 in a longitudinal direction 247 of the frame member 33. The side plate portion 59 is perpendicular to the bottom plate portion 58 and is connected to an end of each of the end portions 117, 118. The side plate portion 60 is provided on the other side of the bottom plate portion 58 in the longitudinal direction 247. The side plate portion 60 is perpendicular to the bottom plate portion 58 and is connected to the other end of each of the end portions 117, 118. Thus, the side plate portions 59, 60 are provided on the respective sides of the bottom plate portion 58 that are opposite to each other in the longitudinal direction 247, so that the frame member 33 as a whole has a generally shallow tray-like shape. As shown in FIG. 8, the side plate portions 59, 60 are fixed to the guide rails 45, 46, so that the frame member 33 is provided with rigidity that avoids the frame member 33 from being easily deformed.

As shown in FIG. 7, the side plate portion 59 has shaft receiver recesses 61, 62, 63 while the side plate portion 60 has shaft receiver recesses 113, 114, 116 and a shaft receiver hole 115. The receiver recesses 61, 113 are provided for receiving therein the shaft 76 of the conveying roller 52. Each of the receiver recesses 61, 113 has an inside diameter that is slightly larger than an outside diameter of the shaft 76, so that the shaft 76 is rotatably held in the receiver recesses 61, 113. The receiver recesses 62, 114 are provided for receiving therein a shaft (not shown) of the motor gear 91. Each of the receiver recesses 62, 114 has an inside diameter that is slightly larger than an outside diameter of the shaft of the motor gear 91, so that the shaft of the motor gear 91 is rotatably held in the receiver recesses 62, 114. The receiver hole 115 is provided for receiving therein the shaft 77 of the intermediate gear 95. The receiver hole 115 has an inside diameter that is slightly larger than an outside diameter of the shaft 77 of the intermediate gear 95, so that the shaft 77 of the intermediate gear 95 is rotatably held in the receiver hole 115.

The receiver recesses 63, 116 are provided for receiving therein the shaft 78 of the discharging roller 55. Each of the receiver recesses 63, 116 has an inside diameter that is slightly larger than an outside diameter of the shaft 78, so that the shaft 78 is rotatably held in the receiver recesses 63, 116. The receiver recesses 63, 116 and the receiver recesses 61, 113 are formed in the side plate portions 59, 60 such that each of the receiver recesses 63, 116 is distant from a corresponding one of the receiver recesses 61, 113 by a predetermined distance as measured in a width direction 248 of the frame member 33. Thus, when the shaft 76 of the conveying roller 52 is received in the receiver recesses 63, 116 and the shaft 78 of the discharging roller 55 is received in the receiver recesses 63, 116, the conveying roller 52 and the discharging roller 55 are distant from each other by a predetermined distance as measured in the width direction 248 (i.e., in the conveying direction 104), so that there is a space available for disposition of the image recording device 40 between the conveying roller 52 and the discharging roller 55.

The shaft 76 of the conveying roller 52 is held at its opposite end portions in the receiver recesses 61, 113. The shaft of the motor gear 91 is held at its opposite end portions in the receiver recesses 62, 114. The shaft 77 of the intermediate gear 95 is held at its portions in the above-described receiver holes 115, 228, 229 and a receiver hole or recess (not shown) that is provided in the side plate portion 59. The shaft 78 of the discharging roller 55 is held at its opposite end portions in the receiver recesses 63, 116. Each of the receiver recesses 61, 62, 63 and a corresponding one of the receiver recesses 113, 114, 116 are positioned in respective positions that are symmetrical with each other with respect to a longitudinal center of the frame 33. The receiver holes 115, 228, 229 are positioned in respective positions that are aligned with one another such that, when the shaft 77 of the intermediate gear 95 is received in the receiver holes 115, 228, 229, an axis of the shaft 77 corresponds to the longitudinal direction 247 of the frame member 33. Thus, the shaft 76 of the conveying roller 52, the shaft of the motor gear 91, the shaft 77 of the intermediate gear 95 and the shaft 78 of the discharging roller 55 are held in parallel with one another, when being held by the frame member 33. Further, an axis of the shaft 76 of the conveying roller 52, an axis of the shaft of the motor gear 91, an axis of the shaft 77 of the intermediate gear 95 and an axis of the shaft 78 of the discharging roller 55 correspond to the longitudinal direction 247 of the frame member 33.

As shown in FIG. 8, the pair of guide rails 45, 46 are disposed on an upper side of the frame member 33. The guide rails 45, 46 are provided for supporting the carriage 41 such that the carriage 41 is slidably movable on the guide rails 45, 46 in directions parallel with the width direction 101 of the multifunction apparatus 10. Each of the guide rails 45, 46 is provided by a platelike member that is elongated in the longitudinal direction 247 of the frame member 33. The guide rail 45 has widthwise opposite end portions 44, 49 that are substantially perpendicularly bent in an upward direction. The guide rail 46 has widthwise opposite end portions 47, 48 that are substantially perpendicularly bent in the upward direction. The end portion 47 extends in the longitudinal direction 247 in which the guide rail 46 is elongated.

The guide rail 45 is fixed to the side plate portions 59, 60 of the frame member 33 through pins 234, 236 which are made of metallic material and which are provided in the respective side plate portions 59, 60, such that the guide rail 45 is located above the receiver recesses 61, 113. The guide rail 45, which is thus fixed to the side plate portions 59, 60 of the frame member 33, is held in parallel with the bottom plate portion 58 of the frame member 33, and a longitudinal direction of the guide rail 45 corresponds to the longitudinal direction 247 of the frame member 33. The guide rail 46 is fixed to the side plate portions 59, 60 of the frame member 33 through pins 235, 237 which are made of metallic material and which are provided in the respective side plate portions 59, 60, such that the guide rail 46 is located above the receiver recesses 63, 116. The guide rail 46, which is thus fixed to the side plate portions 59, 60 of the frame member 33, is held in parallel with the bottom plate portion 58 of the frame member 33, and a longitudinal direction of the guide rail 46 corresponds to the longitudinal direction 247 of the frame member 33. Thus, the guide rails 45, 46 are disposed in parallel with each other.

As shown in FIG. 4, the carriage 41 is arranged to bridge between the guide rails 45, 46, and to grip the end portion 47 of the guide rail 46 through suitable means such as a pair of rollers, such that the carriage 41 is sidable on the guide rails 45, 46. Owing to such an arrangement, the carriage 41 is positioned in a predetermined position in the conveying direction 104, and is reciprocably movable in the width direction 101 that is perpendicular to the conveying direction 104. That is, the carriage 41 is slidably held on the guide rails 45, 46, and is reciprocably movable in the width direction 101 along the end portion 47 of the guide rail 46.

<Main Body>

The lower unit 15 is attached to the upper unit 16 for performing an image recording operation by supplying the recording sheets not only from the second sheet supplying cassette 22 (that is provided in the upper unit 16) but also from the first sheet supplying cassette 21 (that is provided in the lower unit 15). The body 32 of the upper unit 16 is mounted on the body 31 of the lower unit 15, with the bodies 31, 32 being fixedly connected to each other by fasteners such as screws. The bodies 31, 32 of the respective lower and upper units 15, 16 are removably connected to each other, for enabling the printer 11 to be adaptable for a plurality of types of apparatuses. That is, the printer 11 does not necessarily have to be constituted by both of the bodies 31, 32 connected to each other, and may be constituted by the body 32 that is removed from the body 31. Thus, the printer 11 may be constituted by both of the upper and lower units 16, 15, or alternatively, may be constituted by only the upper unit 16.

Each of the bodies 31, 32 is constituted by a single piece that is formed of synthetic resin, so that the multifunction apparatus 10 as a whole can be manufactured with light weight at low cost. Further, each of the bodies 31, 32 has width and depth dimensions as measured in the width and depth directions 101, 103, respectively, and a height dimension as measured in the vertical direction 102 that is smaller than the width and depth dimensions. That is, each of the bodies 31, 32 has a small height so that the apparatus 10 as a whole has a small height. The body 32 of the upper unit 16 includes a pair of second box portions 67, 68 that cooperate with each other to define a second space 65 therebetween, which is available for accommodating therein the second sheet supplying cassette 22 (see FIG. 9). The body 31 of the lower unit 15 includes a pair of first box portions 107, 108 that cooperate with each other to define a first space 66 available for accommodating therein the first sheet supplying cassette 21 (see FIG. 12). Since the space 65 is defined between the box portions 67, 68, the body 32 of the upper unit 16 as a whole has a low rigidity and can be easily distorted. Similarly, the space 66 is defined between the box portions 107, 108, the body 31 of the lower unit 15 as a whole has a low rigidity and can be easily distorted. The body 32 of the upper unit 16 and the body 31 of the lower unit 15 are constructed as described below, for maintaining positional accuracy of each component of the printer 11, irrespective of whether the bodies 31, 32 are connected to each other or not.

<Construction of Body of Upper Unit>

Figure 9:
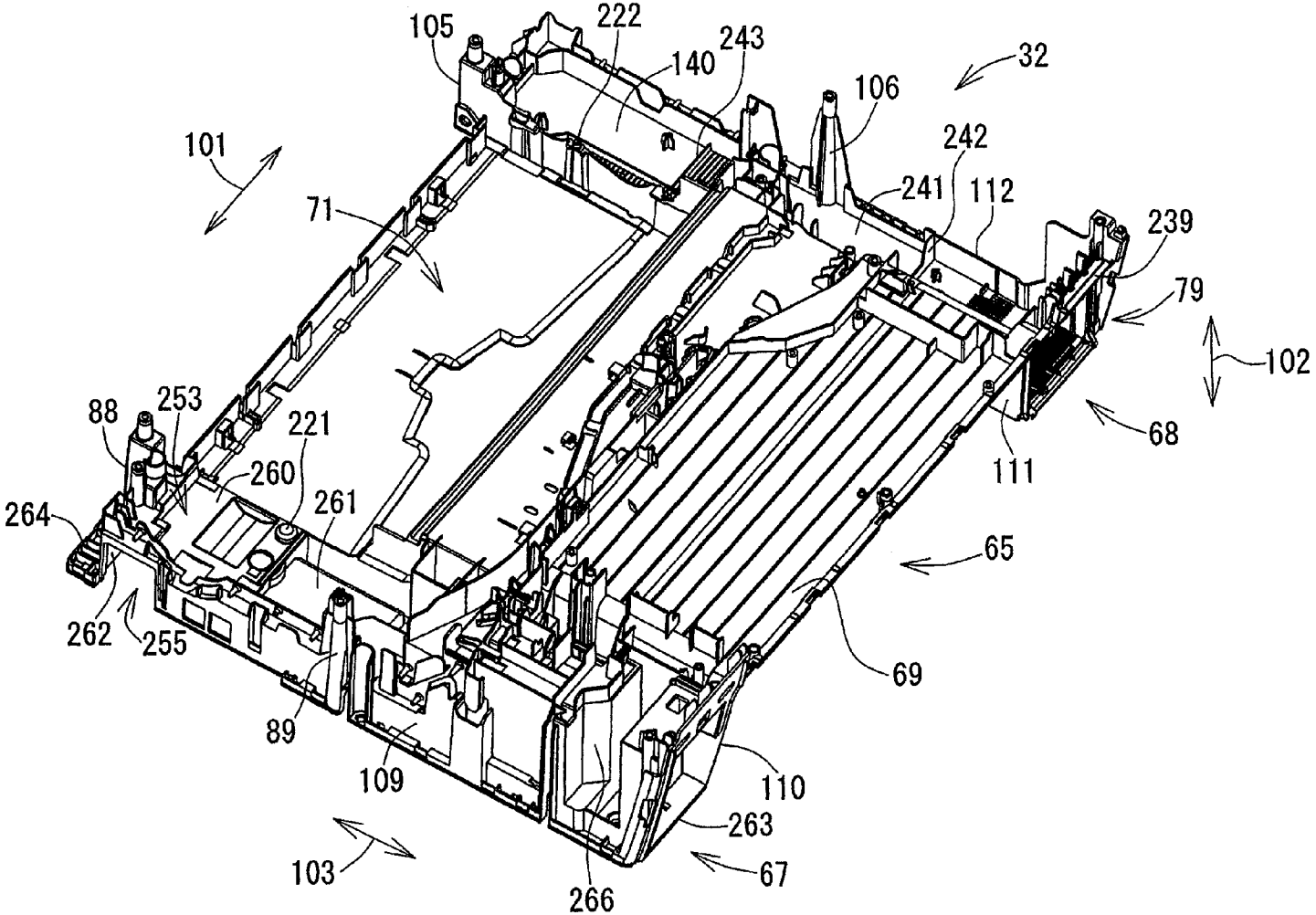
FIG. 9 is a perspective view showing a body 32 of an upper unit 16 of the printer 11.

As shown in FIG. 9, the body 32 of the upper unit 16 has an upper plate portion 69, a support plate portion 70 and a bottom plate portion 71, in addition to the second box portions 67, 68. In the present embodiment, the upper plate portion 69, support plate portion 70 and bottom plate portion 71 cooperate to constitute a second connector interconnecting the second box portions 67, 68. It is noted that the second box portions 67, 68, upper plate portion 69, support plate portion 70 and bottom plate portion 71 are provided by a single piece made of resin.

<Left-Side Box Portion of Body of Upper Unit>

A left-side one of the second box portions 67, 68 (hereinafter referred to as left-side box portion 67) as seen from a front side of the body 32 is set on the installed surface 29 or mounted on a left-side one of the first box portions 107, 108 (hereinafter referred to as left-side box portion 107) as seen from a front side of the body 31. As shown in FIGS. 9-12, the left-side box portion 67 has upper walls 260, 261, a front wall 266, side walls 109, 110, a rear wall 262 and bottom walls 263, 264, 265. The upper wall 260 constitutes a horizontal support surface 253 onto which the frame member 33 is to be set. The above-described protrusion 221 is provided on the upper wall 260, so as to be introduced into the above-described through-hole 231 (see FIG. 7) of the frame member 33. The upper walls 260, 261 are contiguous to each other, in the depth direction 103, via a step defined between the upper walls 260, 261. The side walls 109, 110 extend downwardly from respective opposite ends of each of the upper walls 260, 261, which are opposite to each other in the width direction 101. The side walls 109, 110 are opposed to each other with internal spaces 257, 258 that are defined between the side walls 109, 110 (see FIG. 12). The side walls 109, 110 are connected, at their opposite ends that are opposite in the depth direction 103, to each other via the front wall 266 and the rear wall 262. Further, the left-side box portion 67 has openings 72, 73 that open downwardly (see FIG. 12), so as to have a generally box-like shape.

In the internal space 257, there is a power supply device that is introduced into the space 257 via the opening 72. The power supply device is configured to transform a voltage level of electric power (that is supplied via a power supply cord) into a certain level that is acceptable by the present multifunction apparatus 10, and to transmit the transformed voltage level of electric power toward a control circuit board (not shown) of the apparatus 10. The side wall 109 has an opening 255 through which the power supply cord is to be taken outside the left-side box portion 67. In the internal space 258, there is a communication device that is introduced into the space 258 via the opening 73. The communication device is configured to transmit and receive sound data and image data to and from an external device that is connected to a telephone line, via the telephone line and a telephone terminal.

Figure 12:
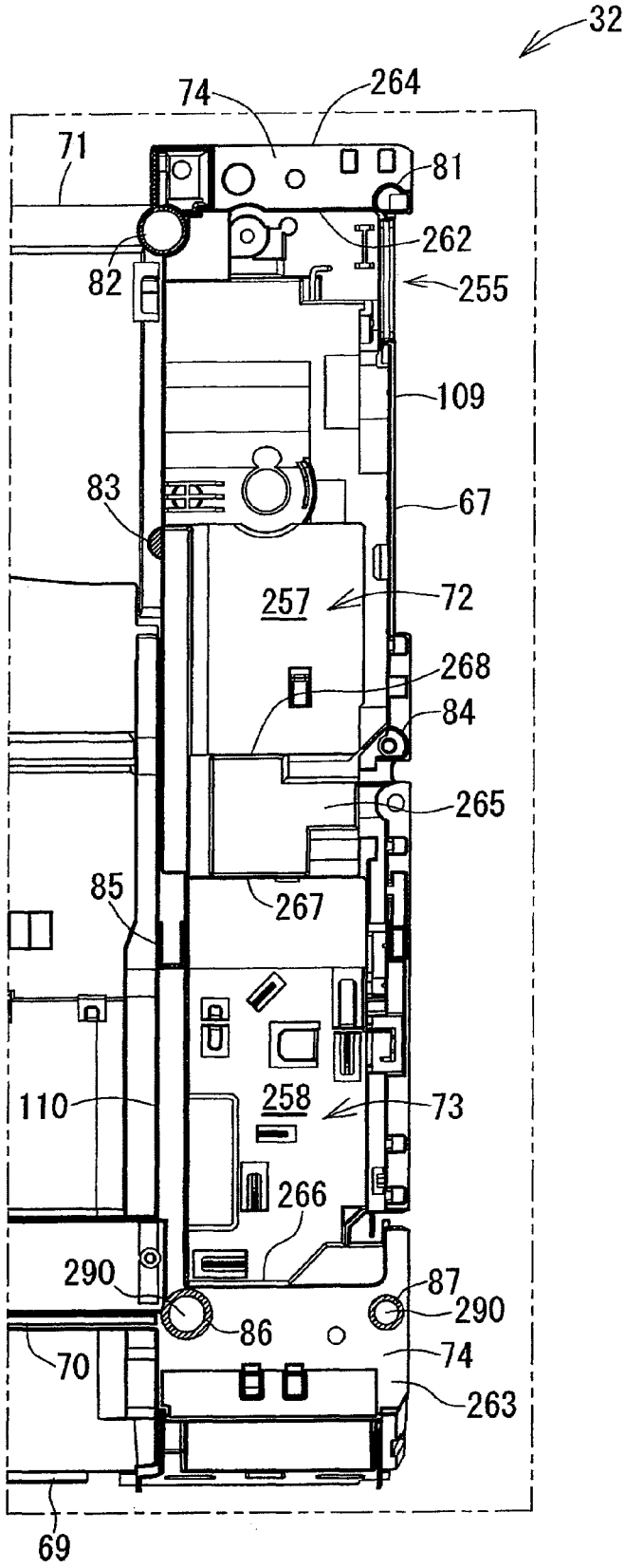
FIG. 12 is a view showing, in enlargement, a part XII of FIG. 11.

As shown in FIG. 12, the side walls 109, 110 are contiguous to each other via a wall 268 that cooperates with the side walls 109, 110 and rear wall 262 to define the internal space 257. Further, the side walls 109, 110 are contiguous to each other via a wall 267 that cooperates with the side walls 109, 110 and front wall 266 to define the internal space 258. Still further, the side walls 109, 110 are contiguous at their distal ends to each other via the bottom walls 263, 264, 265 which cooperate to constitute a bottom surface 74 of the left-side box portion 67. Owing to such a construction, the left-side box portion 67 is provided with rigidity for avoiding the box portion 67 from being easily deformed by a load applied thereto from its upper side.

<Left-Side Foot Portions>

Figure 11:
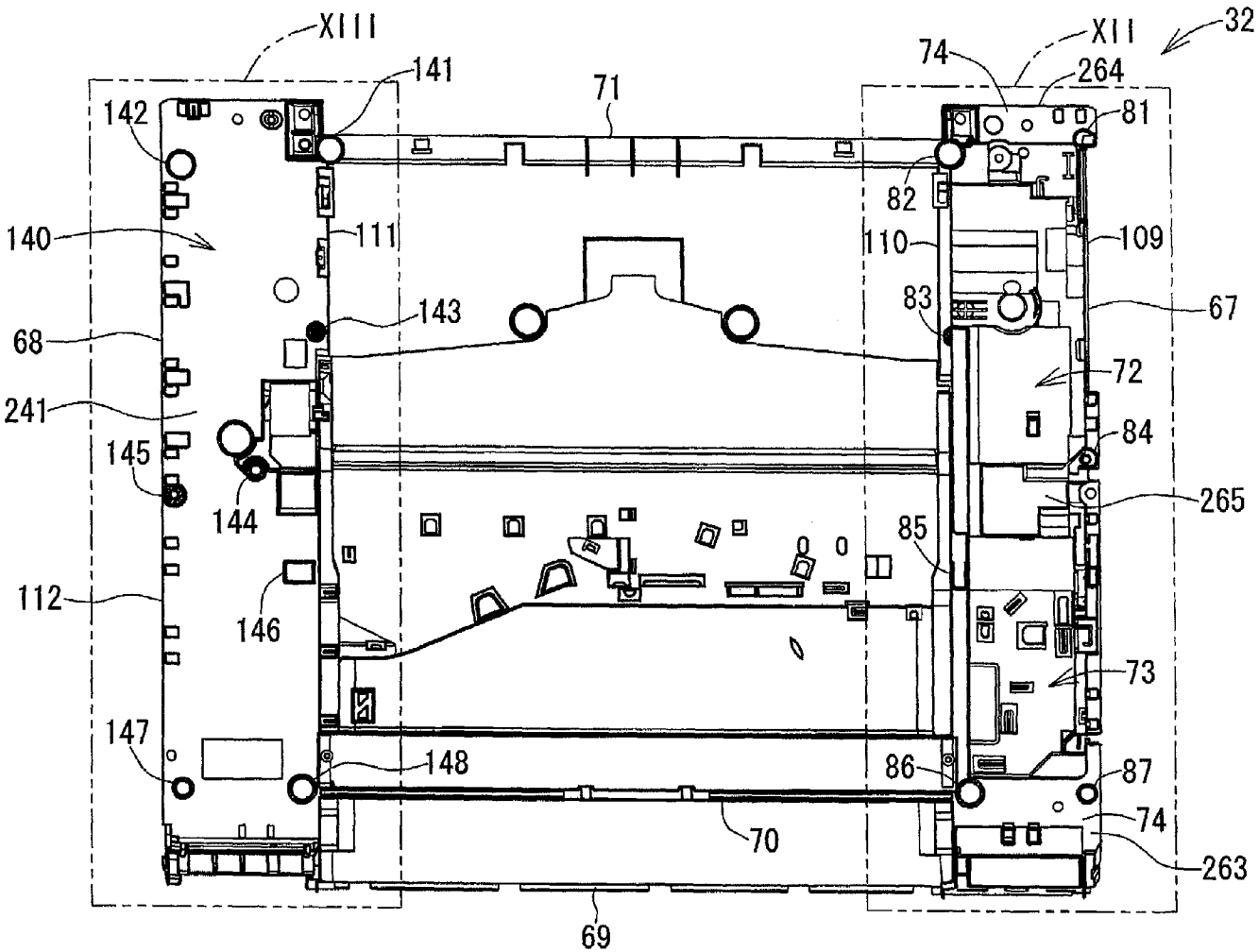
FIG. 11 is a plan view showing a bottom surface of the body 32 of the upper unit 16.

As shown in FIGS. 11 and 12, a total of seven left-side foot portions 81, 82, 83, 84, 85, 86, 87 as second foot portions are provided on the bottom surface 74 of the left-side box portion 67, so as to position the left-side box portion 67 in a position relative to the installed surface 29 or relative to the left-side box portion 107 (see FIG. 14) of the body 31 of the lower unit 15. The left-side foot portions 81-87 protrude downwardly from the bottom surface 74 by respective distances that are equal to one another. Since the left-side foot portions 81-87 protrude by the distances equal to one another, a single plane is defined by distal end surfaces of the respective left-side foot portions 81-87. That is, where the left-side box portion 67 is set on the installed surface 29 that is flat, all of the left-side foot portions 81-87 are held in contact with the installed surface 29, thereby making it possible to stabilize a posture of the left-side box portion 67 relative to the installed surface 29.

As described below in detail, first support portions are provided in the left-side box portion 107 of the body 31 of the lower unit 15. The left-side foot portions 81-87, which are provided on the bottom surface 74 of the left-side box portion 67 of the body 32 of the upper unit 16, are located in respective positions that are aligned with the respective first support portions in the form of supports 121, 122, 123 and columns 124, 125, 126, 127 (see FIG. 15). Therefore, where the body 32 of the upper unit 16 is mounted on the body 31 of the lower unit 15, each of the left-side foot portions 81-87 is held in contact with a corresponding one of the supports 121, 122, 123 and columns 124, 125, 126, 127. Thus, the left-side box portion 67 is supported from its lower side by the left-side box portion 107 of the body 31 of the lower unit 15, owing to contacts of the left-side foot portions 81-87 with top or distal end faces 131, 132, 133, 134, 135, 136, 137 of the supports 121-123 and columns 124-127.

In the present embodiment, since the seven foot portions 81-87 are provided on the bottom surface 74 of the left-side box portion 67, the left-side box portion 67 can maintain its stabilized posture relative to the installed surface 29, independently of the right-side box portion 68. It is noted that, although the total of seven foot portions 81-87 are provided on the bottom surface 74 of the left-side box portion 67 in the present embodiment, the number of the left-side foot portions may be any number that is not smaller than three. For example, a total of nine foot portions may be provided on the bottom surface 74 of the left-side box portion 67. It is preferable that the number of the left-side foot portions is suitable for enabling the posture of the left-side box portion 67 to be stabilized, when the left-side box portion 67 is set on the installed surface 29 or mounted on the left-side box portion 107 of the body 31 of the lower unit 15, without depending on the right-side box portion 68.

As shown in FIG. 9, second support portions in the form of columns 88, 89 are provided on the left-side box portion 67, so that a cover member (not shown) of the upper unit 16 can be fixed to the columns 88, 89. The column 88 extends upwardly from the left-side foot portion 82 (see FIG. 11), so that a load applied to the column 88 is transmitted downwardly through the left-side foot portion 82. The column 89 extends upwardly from the left-side foot portion 84 (see FIG. 11), so that a load applied to the column 89 is transmitted downwardly through the left-side foot portion 84.

<Right-Side Box Portion of Body of Upper Unit>

The right-side box portion 68, as a right-side one of the second box portions 67, 68 as seen from a front side of the body 32, is set on the installed surface 29 or on a right-side one of the first box portions 107, 108 (hereinafter referred to as right-side box portion 108) as seen from a front side of the body 31. The space 65 is defined between the left-side box portion 67 and the right-side box portion 68, for accommodating therein the second sheet supplying cassette 22. Thus, the left-side box portion 67 and right-side box portion 68 are opposed to each other in the width direction 101 of the apparatus 10, and are spaced apart from each other by the space 65 in the width direction 101.

Figure 13:
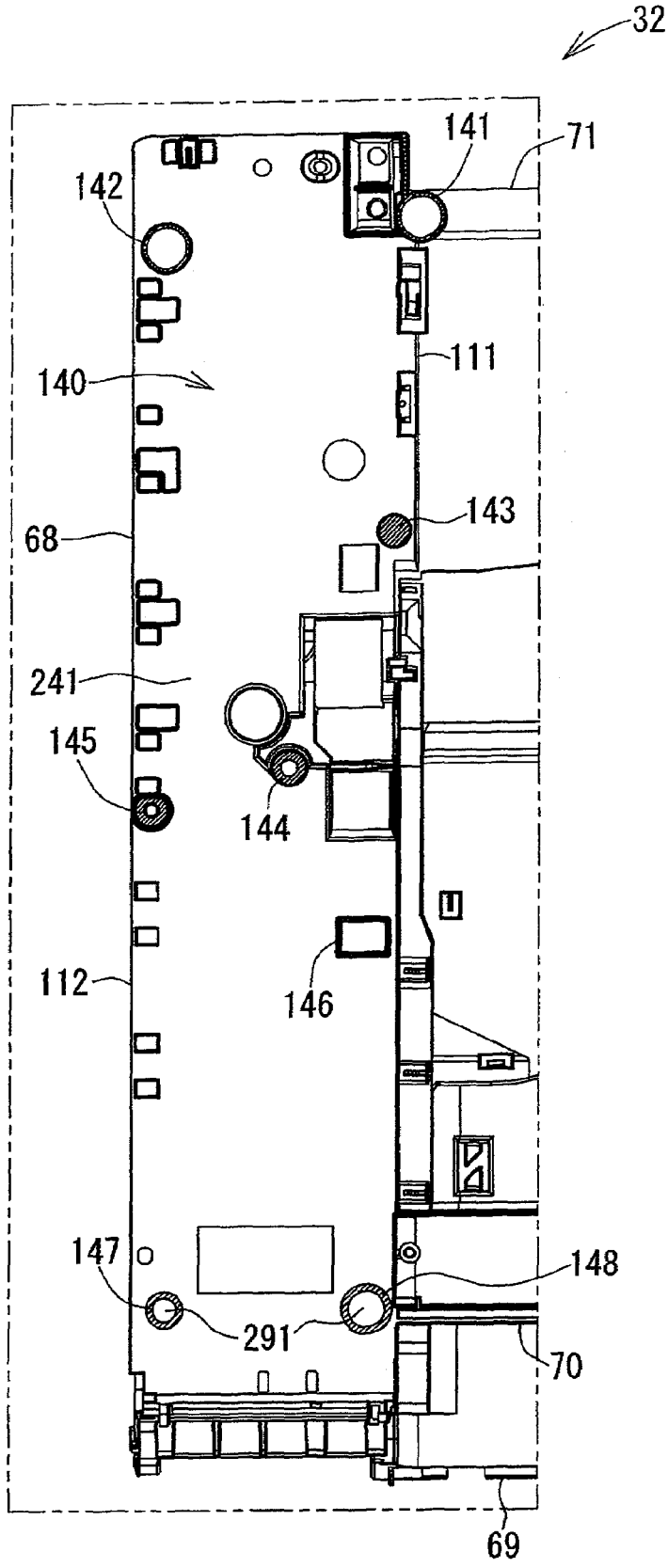
FIG. 13 is a view showing, in enlargement, a part XIII of FIG. 11.

As shown in FIGS. 9 and 13, the right-side box portion 68 has side walls 111, 112, a rear wall 240 and a bottom wall 241 that constitutes a bottom surface 140 of the right-side box portion 68. The side walls 111, 112 extend upwardly from respective opposite ends of the bottom wall 241, which are opposite to each other in the width direction 101. The side walls 111, 112 are connected at their rear ends via the rear wall 240. The right-side box portion 68 has a generally box-like shape, and opens upwardly, and has an opening 79 provided in its front portion.

Figure 10:
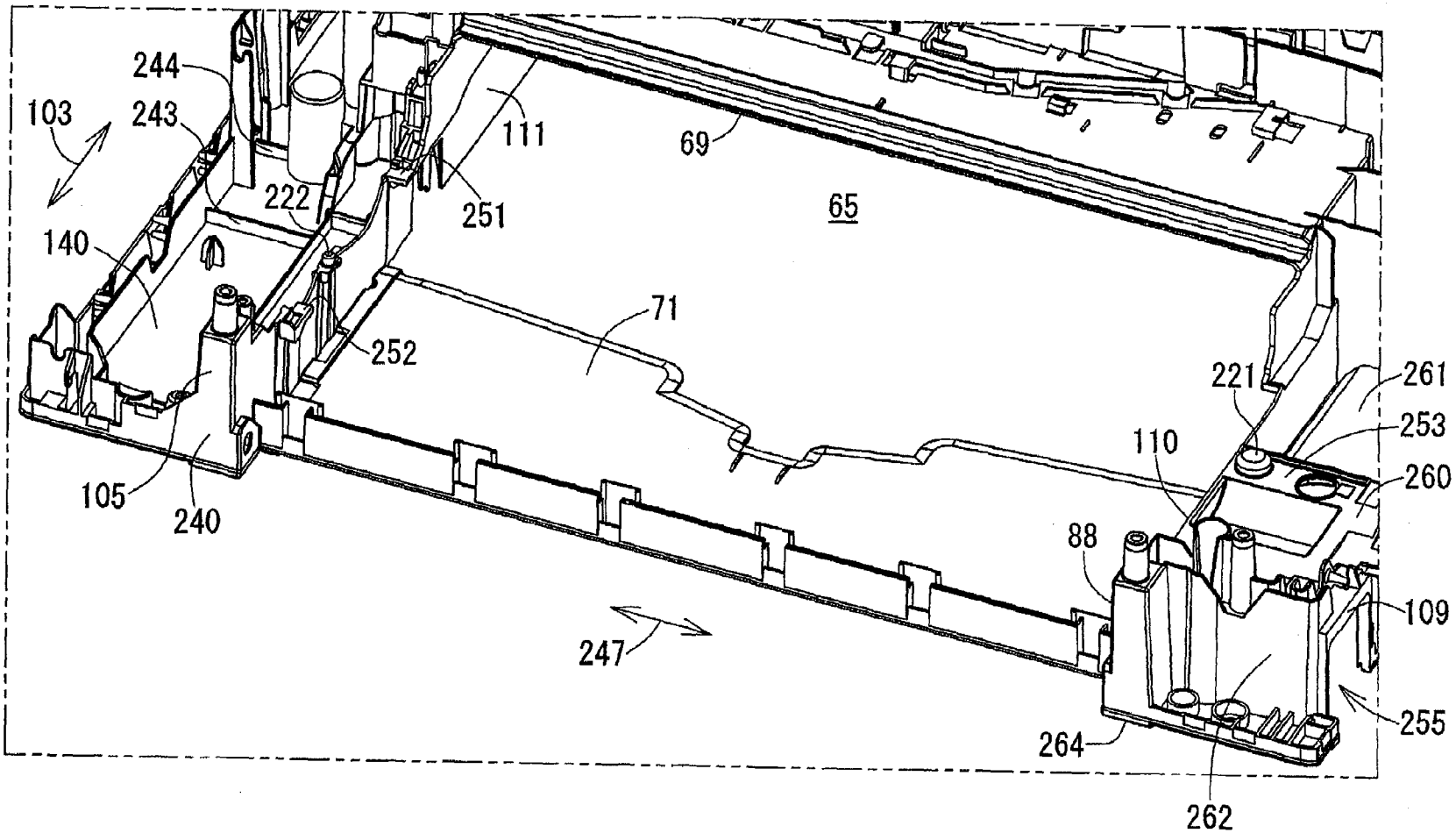
FIG. 10 is a view showing, in enlargement, a part of the body 32 of the upper unit 16 of the printer 11.

As shown in FIG. 10, horizontal support surfaces 251, 252 are provided on a rear portion of an upper end of the side wall 111, for supporting the frame member 33. The support surfaces 251, 252 has the same height as the above-described support surface 253. The above-described protrusion 222 is also provided on the upper end of the side wall 111, so as to be introduced into the through-hole 232 of the frame member 33 (see FIG. 7). This protrusion 222 is located between the support surfaces 251, 252.

As shown in FIG. 9, the above-described opening 79 is provided in the front portion of the right-side box portion 68, and is defined by the bottom wall 241, side walls 111, 112 and a connector 239 that interconnects the side walls 111, 112. The opening 79 is selectively opened and closed by a door 28 (see FIG. 1) which is forwardly pivotable about its pivot axis that is located in vicinity of a lower end of the opening 79. A cartridge holder (not shown) is provided inside the right-side box portion 68, so that ink cartridges are held by the cartridge holder. An ink stored in each of the ink cartridges is supplied to the recording head 42 (see FIG. 4) via ink tubes.

As shown in FIGS. 9 and 10, ribs 242, 243, 244 are provided on the bottom wall 241 of the right-side box portion 68. The ribs 242-244 extend in the width direction 101, and interconnects the side walls 111, 112. The provision of the ribs 242-244 is effective to prevent the bottom wall 241 from being distorted. The side walls 111, 112 are connected, at their rear ends, to each other via the rear wall 240. Further, upper end portions of the respective side walls 111, 112 are connected, at their front ends, to each other via the connector 239. Thus, the side walls 111, 112 are reinforced so that the right-side box portion 68 is provided with rigidity for avoiding the box portion 67 from being easily deformed by a load applied thereto from its upper side.

<Right-Side Foot Portions>

As shown in FIGS. 11 and 13, a total of eight right-side foot portions 141, 142, 143, 144, 145, 146, 147, 148 as second foot portions are provided on the bottom surface 140 of the right-side box portion 68, so as to position the right-side box portion 68 in a position relative to the installed surface 29 or relative to the right-side box portion 108 (see FIG. 14) of the body 31 of the lower unit 15. The right-side foot portions 141-148 protrude downwardly from the bottom surface 140 by respective distances that are equal to one another. Since the right-side foot portions 141-148 protrude by the distances equal to one another, a single plane is defined by distal end surfaces of the respective right-side foot portions 141-148. That is, where the right-side box portion 68 is set on the installed surface 29 that is flat, all of the right-side foot portions 141-148 are held in contact with the installed surface 29, thereby making it possible to stabilize a posture of the right-side box portion 68 relative to the installed surface 29.

As described below in detail, first support portions are provided in the right-side box portion 68 of the body 31 of the lower unit 15. The right-side foot portions 141-148, which are provided on the bottom surface 140 of the right-side box portion 68 of the body 32 of the upper unit 16, are located in respective positions that are aligned with the respective first support portions in the form of supports 150, 151 and columns 152, 153, 154, 155, 156, 157 (see FIG. 14). Therefore, where the body 32 of the upper unit 16 is mounted on the body 31 of the lower unit 15, each of the right-side foot portions 141-148 is held in contact with a corresponding one of the supports 150, 151 and columns 152, 153, 154, 155, 156, 157. Thus, the right-side box portion 68 is supported from its lower side by the right-side box portion 108 of the body 31 of the lower unit 15, owing to contacts of the right-side foot portions 141-148 with top or distal end faces 160, 161, 162, 163, 164, 165, 166, 167 (see FIG. 17) of the supports 150, 151 and columns 152-157.

In the present embodiment, since the eight foot portions 141-148 are provided on the bottom surface 140 of the right-side box portion 68, the right-side box portion 68 can maintain its stabilized posture relative to the installed surface 29, independently of the left-side box portion 67. It is noted that, although the total of eight foot portions 141-148 are provided on the bottom surface 140 of the right-side box portion 68 in the present embodiment, the number of the right-side foot portions may be any number that is not smaller than three. For example, a total of six foot portions may be provided on the bottom surface 74 of the right-side box portion 68. It is preferable that the number of the right-side foot portions is suitable for enabling the posture of the right-side box portion 68 to be stabilized, when the right-side box portion 68 is set on the installed surface 29 or mounted on the right-side box portion 68 of the body 31 of the lower unit 15, without depending on the left-side box portion 67.

As shown in FIG. 9, second support portions in the form of columns 105, 106 are provided on the right-side box portion 68, so that a cover member (not shown) of the upper unit 16 can be fixed to the columns 105, 106. The column 105 extends upwardly from the right-side foot portion 141 (see FIG. 11), so that a load applied to the column 105 is transmitted downwardly through the right-side foot portion 141. The column 106 extends upwardly from the right-side foot portion 145 (see FIG. 11), so that a load applied to the column 106 is transmitted downwardly through the right-side foot portion 145.

<Support Plate Portion>

As shown in FIG. 11, the support plate portion 70 is disposed between the left-side box portion 67 and the right-side box portion 68. The support plate portion 70 constitutes a part of a bottom surface of the body 32 of the upper unit 16, and is provided by a flat plate-shaped portion that is elongated in the width direction 101. The support plate portion 70 is connected at one of its longitudinally opposite ends to the bottom surface 74 of the left-side box portion 67, and is connected at the other of its longitudinally opposite ends to the bottom surface 140 of the right-side box portion 68. Thus, the bottom surface 74 of the left-side box portion 67 and the bottom surface 140 of the right-side box portion 68 are connected to each other via the support plate portion 70.

<Bottom Plate Portion>

As shown in FIGS. 10 and 11, the bottom plate portion 71 is disposed between the left-side box portion 67 and the right-side box portion 68. The bottom plate portion 71 as well as the support plate portion 70 constitutes a part of the bottom surface of the body 32 of the upper unit 16, and is provided by a flat plate-shaped portion that is elongated in the width direction 101. The bottom surface 74 of the left-side box portion 67 and the bottom surface 140 of the right-side box portion 68 are connected to each other via the bottom plate portion 71 as well as the support plate portion 70. The second sheet supplying cassette 22 accommodated in the space 65 is supported from its lower side by the support plate portion 70 and the bottom plate portion 71. It is noted that, although not being shown in FIG. 10, the motor M, the shaft 27 (holding the arm 26) and shafts of the gears G1, G2 are held by the body 32 of the upper unit 16.

<Upper Plate Portion>

As shown in FIG. 9, the upper plate portion 69 is disposed between the left-side box portion 67 and the right-side box portion 68. The upper plate portion 69 is provided by a flat plate-shaped portion that is elongated in the width direction 101, and interconnects an upper end of the side wall 110 of the left-side box portion 67 and an upper end of the side wall 111 of the right-side box portion 68. On the upper plate portion 69, there are provided, for example, the above-described operator's control panel 14 (see FIG. 1) and control circuit board of the multifunction apparatus 10. The space 65 is defined by cooperation of the pair of second box portions and the second connector, i.e., by cooperation of the side wall 110 of the left-side box portion 67, the side wall 111 of the right-side box portion 68, the support plate portion 70, the bottom plate portion 71 and the upper plate portion 69.

As shown in FIG. 6, the frame member 33 is provided on the body 32 of the upper unit 16, and is arranged to bridge between the left-side box portion 67 and the right-side box portion 68. Specifically described, the frame member 33 is mounted on the left-side box portion 67 and the right-side box portion 68 such that the bottom plate portion 58 of the frame member 33 is held in contact with the support surface 253 (see FIG. 10) of the left-side box portion 67 and the support surfaces 251, 252 (see FIG. 10) of the right-side box portion 68, whereby the frame member 33 and the guide rails 45, 46 are held by the body 32 of the upper unit 16 while being held in their horizontal postures. It is noted that, upon setting of the frame member 33 onto the support surfaces 251-253, the protrusions 221, 222 (that are located in vicinity of the support surfaces 251-253) are introduced into the through-holes 231, 232 (see FIG. 7) of the frame member 33, whereby the frame member 33 is accurately positioned in a predetermined position relative to the body 32 of the upper unit 16 such that the axial directions of the shafts 76, 77, 78 (see FIG. 4) and the elongated direction of the guide rails 45, 46 correspond to the width direction 101 of the multifunction apparatus 10.

As described above, the printer 11 can be used by removing the body 31 of the lower unit 15 from the body 32 of the upper unit 16, namely, can be used without the lower unit 15. In case of use of the printer 11 without the lower unit 15, a rubber member 290 as an elastic member may be fixedly provided in each of the annular-shaped left-side foot portions 86, 87 that are provided on the bottom surface 74 of the left-side box portion 67, as shown FIG. 12, while a rubber member 291 as an elastic member may be fixedly provided in each of the annular-shaped right-side foot portions 147, 148 that are provided on the bottom surface 140 of the right-side box portion 67, as shown in FIG. 13. The provision of the elastic members is effective to avoid slipping displacement of each of the left-side box portion 67 and right-side box portion 68 relative to the installed surface 29, and accordingly to prevent distortion of the body 32.

<Construction of Body of Lower Unit>

Figure 14:
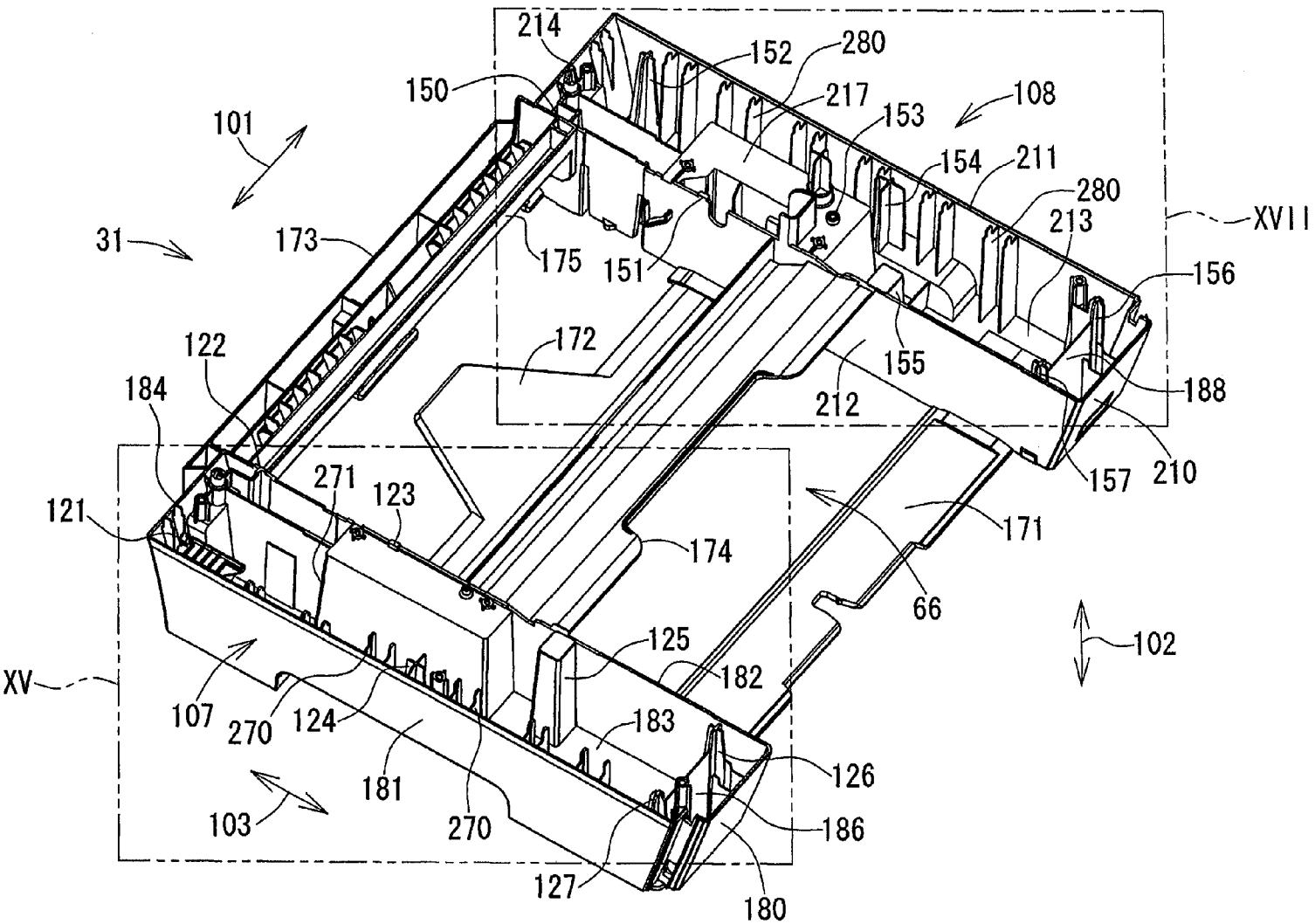
FIG. 14 is a perspective view showing a body 31 of a lower unit 15 of the printer 11.

As shown in FIG. 14, the body 31 of the lower unit 15 has bottom plate portions 171, 172, 173, an upper plate portion 174 and an connecting rod 175, in addition to the first box portions 107, 108. In the present embodiment, the bottom plate portions 171, 172, 173, upper plate portion 174 and connecting rod 175 cooperate to constitute a first connector interconnecting the first box portions 107, 108. It is noted that the first box portions 107, 108, bottom plate portions 171, 172, 173, upper plate portion 174 and connecting rod 175 are provided by a single piece made of resin.

<Left-Side Box Portion of Body of Lower Unit>

A left-side one of the second box portions 107, 108 (hereinafter referred to as left-side box portion 107) as seen from a front side of the body 31 is to support the left-side box portion 67 of the body 32 of the upper unit 16 while being set on the installed surface 29. As shown in FIGS. 14-17, the left-side box portion 107 has a bottom surface 183, side walls 181, 182, a front wall 180 and a rear wall 184. The bottom surface 183 is provided by a plate-like wall that is elongated in the depth direction 103 rather than in the width direction 101. The side walls 181, 182 extend upwardly from respective opposite ends of the bottom surface 183 that are opposite to each other in the width direction 101. The front and rear walls 180, 184 extend from respective opposite ends of the bottom surface 183 that are opposite to each other in the depth direction 103. Each of the front and rear walls 180, 184 extends from a corresponding one of the opposite ends of the bottom surface 183 in a direction that is outwardly inclined with respect to the vertical direction of the multifunction apparatus 10. The side walls 181, 182 are connected, at their opposite ends that are opposed to each other in the depth direction 103, via the front and rear walls 180, 184. Thus, the left-side box portion 107 has a generally box-like shape, and is elongated in the depth direction 103 rather than in the width direction 101. The left-side box portion 107 opens upwardly for supporting the left-side box portion 67 of the body 32 of the upper unit 16.

Figure 15:
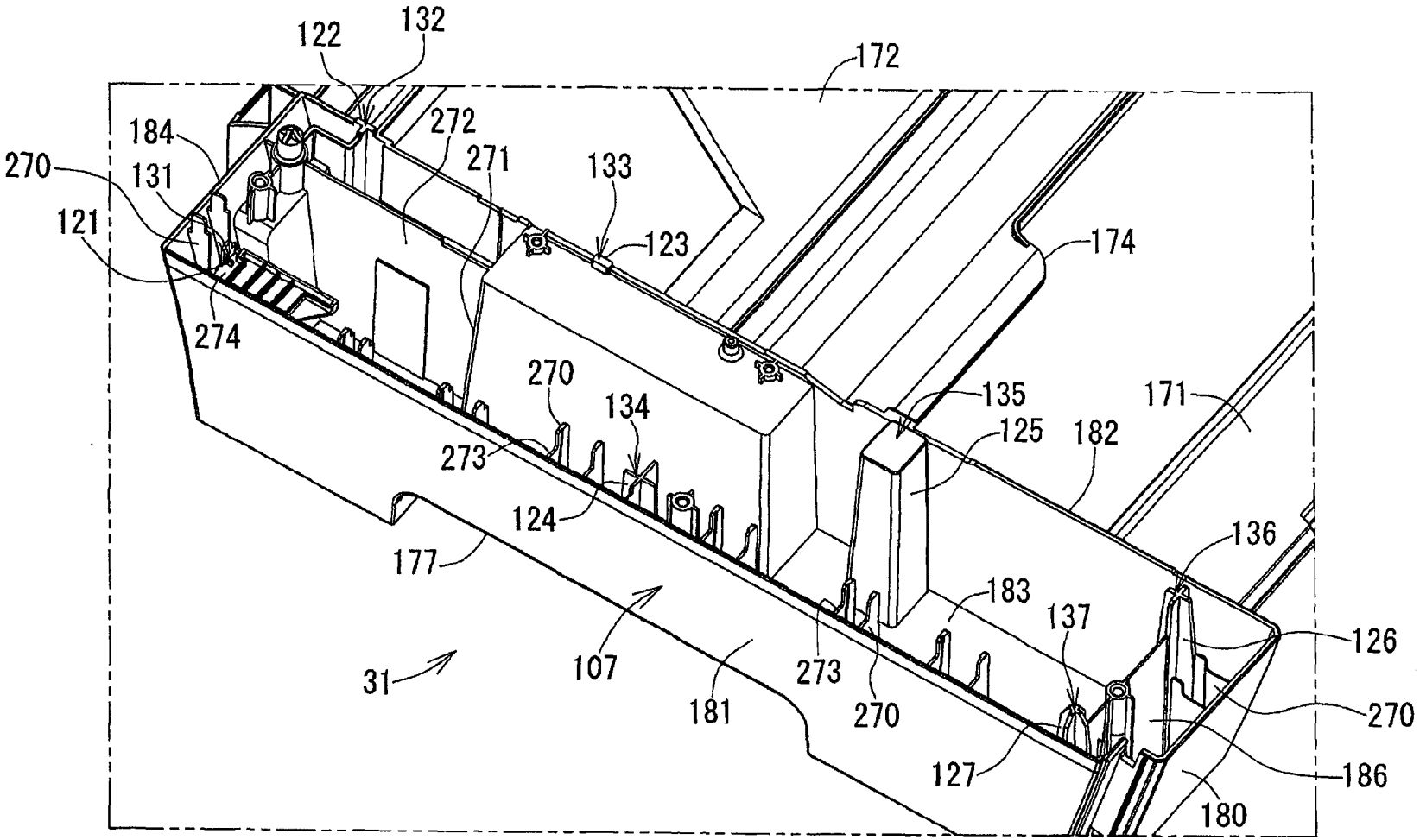
FIG. 15 is a view showing, in enlargement, a part XV of FIG. 14.

The left-side box portion 107 has a recess 177 that is formed by causing a contiguous portion (contiguous to the side wall 181 and the bottom surface 183) to be recessed toward inside of the left-side box portion 107. As shown in FIG. 15, a plurality of ribs 270 are provided on the front wall 180, side wall 181 and rear wall 184, for reinforcing these walls 180, 181, 184 and supporting the side wall 109 and bottom walls 263, 264 of the left-side box portion 67 (see FIG. 9) of the body 32 of the upper unit 16. Each of the ribs 270 has, in vicinity of its upper end, a contact surface 273 (see FIG. 15) with which the side wall 109 and bottom walls 263, 264 of the left-side box portion 67 are to be in contact.

As shown in FIG. 15, a hollow base 271 is provided inside the left-side box portion 107. The base 271 extends from the bottom surface 183, and is contiguous at its side surfaces to the side wall 182. A rib 272 is provided between the base 271 and the rear wall 184, so that the base 271, rear wall 184 and bottom surface 183 are connected to one another via the rib 272. Thus, the left-side box portion 107, which has a generally box-like shape and opens upwardly, is reinforced by the ribs 270, 272, so that the left-side box portion 107 is provided with rigidity for avoiding its deformation, for example, upon mounting of the left-side box portion 67 (of the body 32 of the upper unit 16) onto the left-side box portion 107.

<Supports & Columns>

As shown in FIG. 15, the above-described supports 121, 122, 123 and columns 124, 125, 126, 127 are provided in the left-side box portion 107 of the body 31 of the lower unit 15. The supports 121-123 and columns 124-127 serve to support the left-side foot portions 81, 82, 83, 84, 85, 86, 87 of the left-side box portion 67 of the body 32 of the upper unit 16 (see FIGS. 11 and 12). To this end, each of the supports 121-123 and columns 124-127 of the left-side box portion 107 is positioned in a position aligned with a corresponding one of the left-side foot portions 81-87 of the left-side box portion 67. That is, the supports 121-123 and columns 124-127 are located in respective positions that make it possible to support the left-side foot portions 81-87 from their lower side when the body 32 of the upper unit 16 is mounted on the body 31 of the lower unit 15. Thus, when the body 32 is mounted on the body 31, the left-side foot portions 81-87 are supported by the supports 121-123 and columns 124-127 in place of the horizontal installed surface 29. The distal end faces 131-137 of the respective supports 121-123 and columns 124-127 have the same height, so as to cooperate with one another to define a single plane, for thereby satisfactorily supporting the left-side foot portions 81-87.

The support 121 is provided to support the left-side foot portion 81 (see FIG. 11) of the left-side box portion 67, and protrudes upwardly from a rib 274 that is provided on the side wall 181 (see FIG. 15). The support 122 is provided to support the left-side foot portion 82 (see FIG. 11) of the left-side box portion 67, and protrudes upwardly from an upper end of the side wall 182 (see FIG. 15). The distal end face 132 of the support 122 has generally a T shape in its plan view. The support 123 is provided to support the left-side foot portion 83 (see FIG. 11) of the left-side box portion 67, and protrudes upwardly from the upper end of the side wall 182 (see FIG. 15). The distal end face 133 of the support 123 has a rectangular shape in its plan view, and is elongated in the depth direction 103.

The column 124 is provided to support the left-side foot portion 84 (see FIG. 11) of the left-side box portion 67, and projects upwardly from the bottom surface 183 of the left-side box portion 107 (see FIG. 15). Described specifically, the column 124 extends upwardly from a left-side foot portion 193 (see FIG. 16), and is contiguous to a rib provided on the side wall 181 so as to be supported by the side wall 181. The distal end face 134 of the column 124 has a cross shape in its plan view. The hollow column 125 is provided to support the left-side foot portion 85 (see FIG. 11) of the left-side box portion 67, and projects upwardly from the bottom surface 183 of the left-side box portion 107 (see FIG. 15). Described specifically, the column 125 extends upwardly from a left-side foot portion 194 (see FIG. 16), and is partially provided by the side wall 182 so as to be supported by the side wall 182. The distal end face 135 of the column 125 has a rectangular shape in its plan view.

The columns 126, 127 are provided to support the left-side foot portions 86, 87 (see FIG. 11) of the left-side box portion 67, respectively, and project upwardly from the bottom surface 183 of the left-side box portion 107 (see FIG. 15). Described specifically, the columns 126, 127 extend upwardly from left-side foot portions 195, 196, respectively (see FIG. 16), and have respective cross shapes in their horizontal cross sections. The columns 126, 127 are connected to each other via a rib 186 which extends upwardly from the bottom surface 183 and which is disposed between the columns 126, 127. Each of the distal end faces 136, 137 of the respective columns 126, 127 has a cross shape in its plan view.

<Left-Side Foot Portions>

Figure 16:
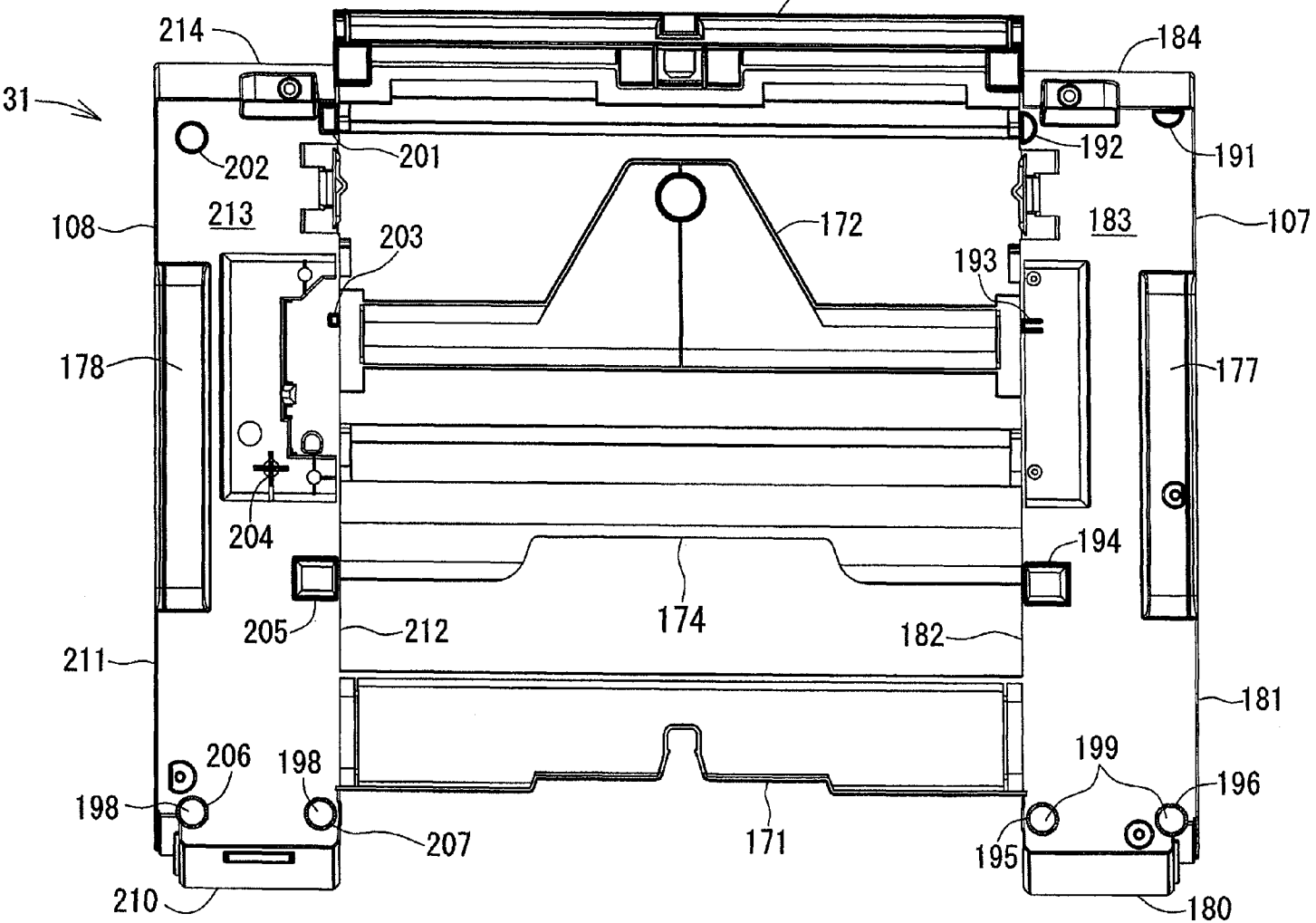
FIG. 16 is a plan view showing a bottom surface of the body 31 of the lower unit 15.

As shown in FIG. 16, a total of six left-side foot portions 191, 192, 193, 194, 195, 196 as first foot portions are provided on the bottom surface 183 of the left-side box portion 107. The left-side foot portions 191-196 are provided to be held in contact with the installed surface 29 (see FIG. 1) whereby the left-side box portion 107 is positioned in a predetermined position relative to the installed surface 29. The left-side foot portions 191-196 protrude downwardly from the bottom surface 183 by respective distances that are equal to one another. Since the left-side foot portions 191-196 protrude by the distances equal to one another, a single plane is defined by distal end surfaces of the respective left-side foot portions 191-196. That is, where the left-side box portion 107 is set on the installed surface 29 that is flat, all of the left-side foot portions 191-196 are held in contact with the installed surface 29, thereby making it possible to stabilize a posture of the left-side box portion 107 relative to the installed surface 29.

The distal end surface of the left-side foot portion 191 has generally a semicircular shape in its plan view (see FIG. 16). The left-side foot portion 191 is located in a position substantially aligned with the support 121 in a horizontal direction (see FIG. 14). The distal end surface of the left-side foot portion 192 has generally a semicircular shape in its plan view (see FIG. 16). The left-side foot portion 192 is located in a position substantially aligned with the support 122 in the horizontal direction (see FIG. 14). The distal end surface of the left-side foot portion 193 has generally a U shape in its plan view (see FIG. 16). The left-side foot portion 193 is located in a position substantially aligned with the support 123 in the horizontal direction (see FIG. 14).

The distal end surface of the left-side foot portion 194 has generally a rectangular shape in its plan view (see FIG. 16). The left-side foot portion 194 is provided on one of opposite sides of the bottom wall 183 of the left-side box portion 107 which is remote from the support 125 (see FIG. 14), and is located in a position substantially aligned with the support 125 in the horizontal direction. Each of the distal end surfaces of the respective left-side foot portions 195, 196 has generally a circular shape in its plan view (see FIG. 16). The left-side foot portion 195 is provided on one of opposite sides of the bottom wall 183 which is remote from the support 126 (see FIG. 14), and is located in a position substantially aligned with the support 126 in the horizontal direction. The left-side foot portion 196 is provided on one of opposite sides of the bottom wall 183 which is remote from the support 127 (see FIG. 14), and is located in a position substantially aligned with the support 127 in the horizontal direction. A disk-shaped rubber member 199 as an elastic member may be fixedly provided in each of the annular-shaped left-side foot portions 195, 196 that are provided on the bottom surface 183 of the left-side box portion 107. The provision of the elastic members is effective to avoid slipping displacement of the left-side box portion 107 relative to the installed surface 29, where the installed surface 29 is provided by a flat surface. It is noted that, although the rubber member 199 is provided in each of only the left-side foot portions 195, 196, the rubber member 199 may be provided in each of the other left-side foot portions such as the left-side foot portions 191, 192.

Since the supports 121-123, columns 124-127 and left-side foot portions 191-196 are arranged as described above, a load applied to each of the supports 121-123 and columns 124-127 is transmitted downwardly to the installed surface 29 via the left-side foot portions 191-196. Thus, the left-side box portion 107 is prevented from being easily deformed. That is, the left-side box portion 107 is not deformed by mounting the left-side box portion 67 onto the left-side box portion 107.

In the present embodiment, since the six left-side foot portions 191-196 are provided on the bottom surface 183 of the left-side box portion 107, the left-side box portion 107 can maintain its stabilized posture relative to the installed surface 29, independently of the right-side box portion 108. It is noted that, although the total of six foot portions 191-196 are provided on the bottom surface 183 of the left-side box portion 107 in the present embodiment, the number of the left-side foot portions may be any number that is not smaller than three. For example, a total of nine foot portions may be provided on the bottom surface 183 of the left-side box portion 107. It is preferable that the number of the left-side foot portions is suitable for enabling the posture of the left-side box portion 107 to be stabilized, when the left-side box portion 107 is set on the installed surface 29, without depending on the right-side box portion 108.

<Right-Side Box Portion of Body of Lower Unit>

The right-side box portion 108, as a right-side one of the second box portions 107, 108 as seen from a front side of the body 31 is set on the installed surface 29, while supporting the right-side box portion 68 of the upper unit 16 from its lower side. The space 66 is defined between the left-side box portion 107 and the right-side box portion 108, for accommodating therein the first sheet supplying cassette 21. Thus, the left-side box portion 107 and right-side box portion 108 are opposed to each other in the width direction 101 of the apparatus 10, and are spaced apart from each other by the space 66 in the width direction 101.

Figure 17:
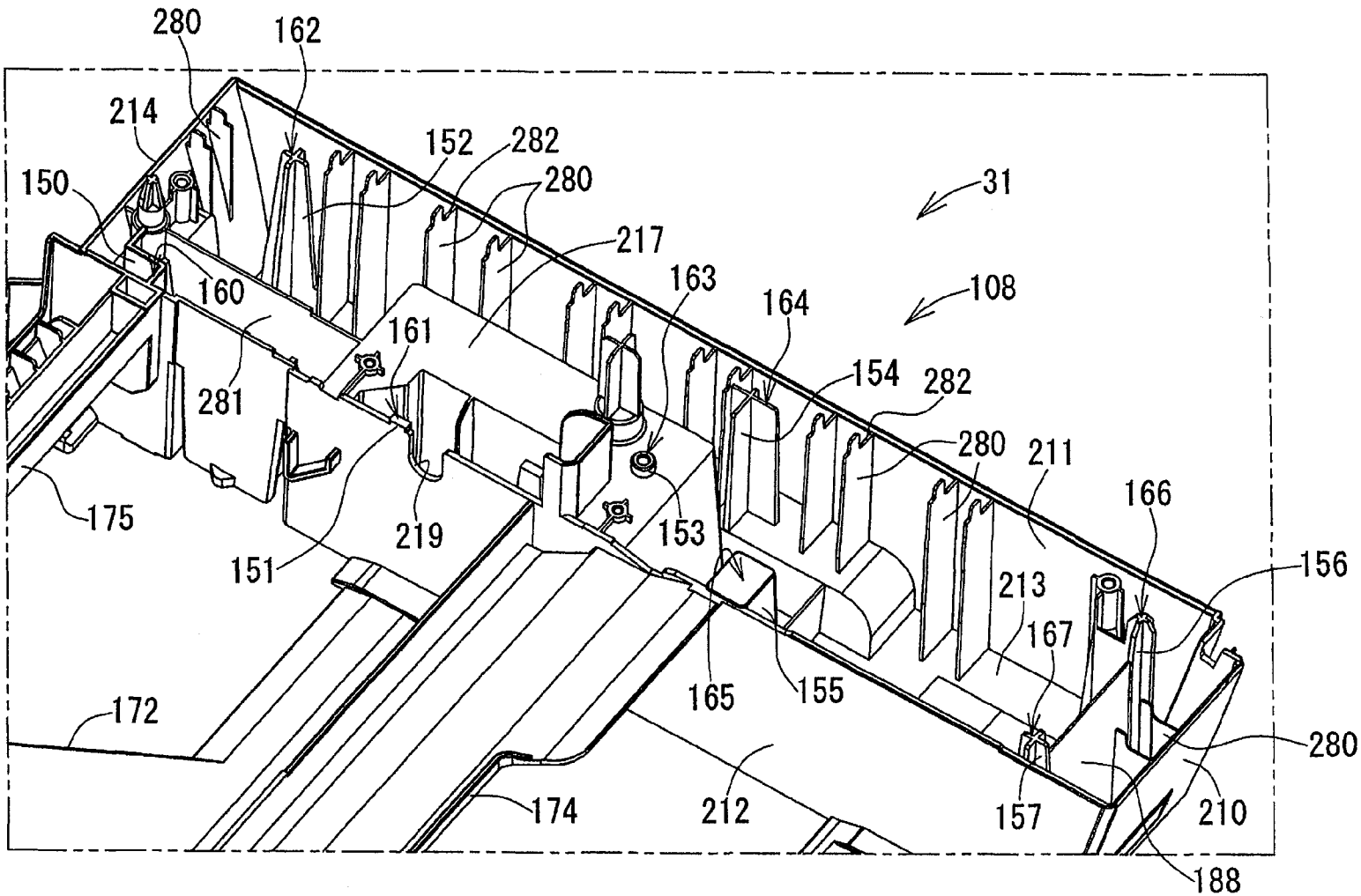
FIG. 17 is a view showing, in enlargement, a part XVII of FIG. 14.

As shown in FIG. 17, the right-side box portion 108 has a bottom surface 213 (see FIG. 16), side walls 211, 212, a front wall 210 and a rear wall 214. Like the bottom surface 183, the bottom surface 213 is provided by a plate-like wall that is elongated in the depth direction 103 rather than in the width direction 101. The side walls 211, 212 extend upwardly from respective opposite ends of the bottom surface 213 that are opposite to each other in the width direction 101. The front and rear walls 210, 214 extend from respective opposite ends of the bottom surface 213 that are opposite to each other in the depth direction 103. Each of the front and rear walls 210, 214 extends from a corresponding one of the opposite ends of the bottom surface 213 in a direction that is outwardly inclined with respect to the vertical direction of the multifunction apparatus 10. The side walls 211, 212 are connected, at their opposite ends that are opposed to each other in the depth direction 103, via the front and rear walls 210, 214. Thus, the right-side box portion 108 has a generally box-like shape, and is elongated in the depth direction 103 rather than in the width direction 101. The right-side box portion 108 opens upwardly for supporting the right-side box portion 68 of the body 32 of the upper unit 16.

The right-side box portion 108 has a recess 178 that is formed by causing a contiguous portion (contiguous to the side wall 211 and the bottom surface 213) to be recessed toward inside of the right-side box portion 108. As shown in FIG. 17, a plurality of ribs 280 are provided on the front wall 210, side wall 211 and rear wall 214, for reinforcing these walls 210, 211, 214 and supporting the bottom wall 241 of the right-side box portion 68 (see FIG. 9) of the body 32 of the upper unit 16. Each of the ribs 280 has, in vicinity of its upper end, a contact surface 282 (see FIG. 17) with which the bottom wall 241 of the right-side box portion 68 is to be in contact.

As shown in FIG. 17, a hollow base 217 is provided inside the right-side box portion 108. The base 217 extends from the bottom surface 213, and is contiguous at its side surfaces to the side wall 212. A rib 281 is provided between the base 217 and the rear wall 214, so that the base 217, rear wall 214 and bottom surface 213 are connected to one another via the rib 281. Thus, the right-side box portion 108, which has a generally box-like shape and opens upwardly, is reinforced by the ribs 280, 281, so that the right-side box portion 108 is provided with rigidity for avoiding its deformation, for example, upon mounting of the right-side box portion 68 (of the body 32 of the upper unit 16) onto the right-side box portion 108.

<Supports & Columns>

As shown in FIG. 17, the above-described supports 150, 151 and columns 152, 153, 154, 155, 156, 157 are provided in the right-side box portion 108 of the body 31 of the lower unit 15. The supports 150, 151 and columns 152-157 serve to support the right-side foot portions 141, 142, 143, 144, 145, 146, 147, 148 of the right-side box portion 68 of the body 32 of the upper unit 16 (see FIGS. 11 and 13). To this end, each of the supports 150, 151 and columns 152-157 of the right-side box portion 108 is positioned in a position aligned with a corresponding one of the right-side foot portions 141-148 of the right-side box portion 68. That is, the supports 150, 151 and columns 152-157 are located in respective positions that make it possible to support the right-side foot portions 141-148 from their lower side when the body 32 of the upper unit 16 is mounted on the body 31 of the lower unit 15. Thus, when the body 32 is mounted on the body 31, the right-side foot portions 141-148 are supported by the supports 150, 151 and columns 152-157 in place of the horizontal installed surface 29. The distal end faces 160-167 of the respective supports 150, 151 and columns 152-157 have the same height, so as to cooperate with one another to define a single plane, for thereby satisfactorily supporting the right-side foot portions 141-148.

The support 150 is provided to support the right-side foot portion 141 (see FIG. 11) of the right-side box portion 68, and protrudes upwardly from a portion of an upper end of the side wall 212 and a portion of an upper end of the connecting rod 175 (see FIG. 17). The support 151 is provided to support the right-side foot portion 143 (see FIG. 11) of the right-side box portion 68, and protrudes upwardly from an upper end of the side wall 212 (see FIG. 17) of the right-side box portion 108. The distal end face 161 of the support 151 has a rectangular shape in its plan view, and is elongated in the depth direction 103.

The column 152 is provided to support the right-side foot portion 142 (see FIG. 11) of the right-side box portion 68, and projects upwardly from the bottom surface 213 of the right-side box portion 108 (see FIG. 17). Described specifically, the column 152 extends upwardly from a right-side foot portion 202 (see FIG. 16), and the distal end face 162 of the column 152 has a cross shape in its plan view. The cylindrical-shaped column 153 is provided to support the right-side foot portion 144 (see FIG. 11) of the right-side box portion 68, and projects upwardly from a base 217 that is provided inside the right-side box portion 108 (see FIG. 17).

The column 154 is provided to support the right-side foot portion 145 (see FIG. 11) of the right-side box portion 68, and projects upwardly from the bottom surface 213 of the right-side box portion 108 (see FIG. 17). Described specifically, the column 154 extends upwardly from the recess 178 that is provided on the bottom surface 213, and has a cross shape in its horizontal cross section. The distal end face 164 of the column 154 has a cross shape in its plan view. The hollow column 155 is provided to support the right-side foot portion 146 (see FIG. 11) of the right-side box portion 68, and projects upwardly from the bottom surface 213 of the right-side box portion 108 (see FIG. 17). Described specifically, the column 155 extends upwardly from a right-side foot portion 205 (see FIG. 16), and is partially provided by the side wall 212 so as to be supported by the side wall 212. The distal end face 165 of the column 155 has a rectangular shape in its plan view. Thus, the column 155 has substantially the same shape as the above-described column 125.

The columns 156, 157 are provided to support the right-side foot portions 147, 148 (see FIG. 11) of the right-side box portion 68, respectively, and project upwardly from the bottom surface 213 of the right-side box portion 108 (see FIG. 17). The columns 156, 157 have substantially the same construction as the above-described columns 126, 127. Described specifically, the columns 156, 157 extend upwardly from right-side foot portions 206, 207, respectively (see FIG. 16), and have respective cross shapes in their horizontal cross sections. The columns 156, 157 are connected to each other via a rib 188 which extends upwardly from the bottom surface 213 and which is disposed between the columns 156, 157. Each of the distal end faces 166, 167 of the respective columns 156, 157 has a cross shape in its plan view.

<Right-Side Foot Portions>

As shown in FIG. 16, a total of seven right-side foot portions 201, 202, 203, 204, 205, 206 as first foot portions are provided on the bottom surface 213 of the right-side box portion 108. The right-side foot portions 201-207 are provided to be held in contact with the installed surface 29 (see FIG. 1) whereby the right-side box portion 108 is positioned in a predetermined position relative to the installed surface 29. The right-side foot portions 201-207 protrude downwardly from the bottom surface 213 by respective distances that are equal to one another. Since the right-side foot portions 201-207 protrude by the distances equal to one another, a single plane is defined by distal end surfaces of the respective right-side foot portions 201-207. That is, where the right-side box portion 108 is set on the installed surface 29 that is flat, all of the right-side foot portions 201-207 are held in contact with the installed surface 29, thereby making it possible to stabilize a posture of the right-side box portion 108 relative to the installed surface 29.

The distal end surface of the right-side foot portion 201 has generally a rectangular shape in its plan view (see FIG. 16). The right-side foot portion 201 is located in a position substantially aligned with the support 150 in the horizontal direction (see FIG. 14). The distal end surface of the right-side foot portion 202 has generally a circular shape in its plan view (see FIG. 16). The right-side foot portion 202 is located in a position substantially aligned with the support 152 in the horizontal direction (see FIG. 14). The distal end surface of the right-side foot portion 203 has generally a rectangular shape in its plan view (see FIG. 16). The right-side foot portion 203 is located in a position substantially aligned with the support 151 in the horizontal direction (see FIG. 14). The distal end surface of the right-side foot portion 204 has generally a cross shape in its plan view (see FIG. 16). The right-side foot portion 204 is located in a position substantially aligned with the support 153 in the horizontal direction (see FIG. 14).

The distal end surface of the right-side foot portion 205 has generally a U shape in its plan view (see FIG. 16), and is located in a position substantially aligned with the support 155 in the horizontal direction (see FIG. 14). The right-side foot portions 206, 207 are located in respective positions that are substantially aligned with the supports 156, 157, respectively. A disk-shaped rubber member 198 as an elastic member may be fixedly provided in each of the annular-shaped right-side foot portions 206, 207 that are provided on the bottom surface 213 of the right-side box portion 108. The provision of the elastic members is effective to avoid slipping displacement of the right-side box portion 108 relative to the installed surface 29, where the installed surface 29 is provided by a flat surface. It is noted that, although the rubber member 198 is provided in each of only the right-side foot portions 206, 207, the rubber member 198 may be provided in each of the other right-side foot portions such as the right-side foot portion 202.

Since the supports 150, 151, columns 152-157 and right-side foot portions 201-207 are arranged as described above, a load applied to each of the supports 150, 151 and columns 152-157 is transmitted downwardly to the installed surface 29 via the right-side foot portions 201-207. Thus, the right-side box portion 108 is prevented from being easily deformed. That is, the right-side box portion 108 is not deformed by mounting the right-side box portion 68 onto the right-side box portion 108.

In the present embodiment, since the seven right-side foot portions 201-207 are provided on the bottom surface 213 of the right-side box portion 108, the right-side box portion 108 can maintain its stabilized posture relative to the installed surface 29, independently of the left-side box portion 107. It is noted that, although the total of seven foot portions 201-207 are provided on the bottom surface 213 of the right-side box portion 108 in the present embodiment, the number of the right-side foot portions may be any number that is not smaller than three. For example, a total of nine foot portions may be provided on the bottom surface 213 of the right-side box portion 108. It is preferable that the number of the right-side foot portions is suitable for enabling the posture of the right-side box portion 108 to be stabilized, when the right-side box portion 108 is set on the installed surface 29, without depending on the left-side box portion 107.

As shown in FIG. 14, the bottom plate portions 171, 172, 173 are disposed between the left-side box portion 107 and the right-side box portion 108. Each of the bottom plate portions 171-173 is contiguous, at one of its opposite end portions opposite to each other in the width direction 101, to the bottom surface 183 of the left-side box portion 107, and is contiguous, at the other end portion, to the bottom surface 213 of the right-side box portion 108, so that the left-side box portion 107 and the right-side box portion 108 are connected via the bottom plate portions 171-173. The above-described first sheet supplying cassette 21 accommodated in the space 66 is supported from its lower side by the bottom plate portions 171-173. The above-described sheet supplying roller 35, arm 36 and shaft 37 are disposed above the bottom plate portion 172, although not being illustrated in FIG. 14. The shaft 37 is rotatably received in a shaft receiver recess 219 (see FIG. 17) that is provided in the side wall 212 of the right-side box portion 108.

As shown in FIG. 14, the upper plate portion 174 and the connecting rod 175 are disposed between an upper end of the side wall 182 of the left-side box portion 107 and an upper end of the side wall 212 of the right-side box portion 108. Each of the upper plate portion 174 and connecting rod 175 is contiguous, at one of its opposite end portions opposite to each other in the width direction 101, to the side wall 182 of the left-side box portion 107, and is contiguous, at the other end portion, to the side wall 212 of the left-side box portion 108, so that the left-side box portion 107 and the right-side box portion 108 are connected via the upper plate portion 174 and connecting rod 175. The upper plate portion 174, which is provided by a flat plate-shaped portion elongated in the width direction 101, is positioned between the above-described support plate portion 70 and bottom plate portion 71 (see FIG. 11) in a state in which the body 31 of the lower unit 15 and the body 32 of the upper unit 16 are connected to each other. The above-described space 66 is defined by cooperation of the pair of first box portions and the first connector, i.e., by cooperation of the side wall 182 of the left-side box portion 107, the side wall 212 of the right-side box portion 108, the bottom plate portions 171-173, upper plate portion 174 and connecting rod 175.

<Advantageous Effects>

As described above, in the body 32 of the upper unit 16, the left-side foot portions 81-87 are provided on the bottom surface 74 of the left-side box portion 67 while the right-side foot portions 141-148 are provided on the bottom surface 140 of the right-side box portion 68. Therefore, the multifunction apparatus 10 as the image recording apparatus can be used by removing the body 31 of the lower unit 15 from the body 32 of the upper unit 16, namely, can be used without the lower unit 15. Further, owing to the seven left-side foot portions 81-87 and the eight right-side foot portions 141-148, the shape of the left-side box portion 67 and the shape of the right-side box portion 68 can be stabilized, even without each one of the box portions 67, 68 depending on the other of the box portions 67, 68, while the multifunction apparatus 10 is being installed on the installed surface 29. It is therefore possible to prevent distortion of the body 32 of the upper unit 16 and to accordingly avoid reduction of the positional accuracy of each component (such as the conveying device 50 and the image recording device 24) which is held by the frame member 33.

As described above, in the body 31 of the lower unit 15, the six left-side foot portions 191-196 are provided on the bottom surface 183 of the left-side box portion 107 while the seven right-side foot portions 201-207 are provided on the bottom surface 213 of the right-side box portion 108. Therefore, the shape of the left-side box portion 107 and the shape of the right-side box portion 108 can be stabilized, even without each one of the box portions 107, 108 depending on the other of the box portions 107, 108, while the multifunction apparatus 10 is being installed on the installed surface 29.

Further, as described above, in the left-side box portion 107 of the body 31, the supports 121-123 and columns 124-127 having their proximal end portions in the form of the left-side foot portions 191-196 are provided for supporting the left-side box portion 67 of the body 32 of the upper unit 16. In the right-side box portion 108 of the body 31, the supports 150, 151 and columns 152-157 having their proximal end portions in the form of the right-side foot portions 201-207 are provided for supporting the right-side box portion 68 of the body 32 of the upper unit 16. In a state in which the bodies 31, 32 of the upper and lower units 15, 16 are connected to each other, the left-side box portion 67 is supported from its lower side by the supports 121-123 and columns 124-127 of the left-side box portion 107 while the right-side box portion 68 is supported from its lower side by the supports 150, 151 and columns 152-157 of the right-side box portion 108. In this state, therefore, a load acting on the left-side box portion 67 is transmitted vertically downwardly to the installed surface 29 via the left-side foot portions 81-87 of the left-side box portion 67 and the supports 121-123, columns 124-127 and left-side foot portions 191-196 of the left-side box portion 107, while a load acting on the right-side box portion 68 is transmitted vertically downwardly to the installed surface 29 via the right-side foot portions 141-148 of the right-side box portion 68 and the supports 150, 151, columns 152-157 and right-side foot portions 201-207 of the right-side box portion 108. Therefore, the shape of the left-side box portion 67 and the shape of the right-side box portion 68 can be stabilized, even without each one of the box portions 67, 68 depending on the other of the box portions 67, 68, as in a case in which the box portions 67, 68 are installed directly on the installed surface 29.

The frame member 33 is provided to bridge between the box portions 67, 68 of the body 32 of the upper unit 16, as described above, so that it is possible to maintain the positional accuracy of each component (such as the conveying device 50 and the image recording device 24) which is held by the frame member 33, irrespective of whether the bodies 31, 32 of the respective lower and upper units 15, 16 are connected to each other or not. In a state in which the bodies 31, 32 are connected to each other, namely, in a state in which the body 32 is mounted on the body 31, the shapes of the respective box portions 107, 108 of the first body 31 are further stabilized owing to weights of the respective box portions 67, 68 of the second body 32 which act on the box portions 107, 108 of the first body 31. It is possible to maintain the positional accuracy of each of the box portions 107, 108 of the first body 31, even without a frame member reinforcing the box portions 107, 108. That is, in the present multifunction apparatus 10, it is possible to maintain the positional accuracy of each component of the apparatus 10, irrespective of whether the bodies 31, 32 of the respective lower and upper units 15, 16 are connected to each other or not.

As described above, the conveying device 50 includes the conveying roller 52 as the first roller and the discharging roller 55 as the second roller. As long as axes of the rollers 52, 55 are held in parallel to each other, each recording sheet can be conveyed precisely in the conveying direction. However, if the body 32 of the upper unit 16 suffers from distortion, for example, if one of the box portions 67, 68 is displaced relative to the other of the box portions 67, 68, the parallelism between the axes of the rollers 52, 55 would be lost whereby each recording sheet is likely to be conveyed in a direction that is problematically inclined with respect to the conveying direction. Such a problem can be eliminated owing to the above-described construction effective to maintain the positional accuracy of each component of the apparatus 10.

As described above, the carriage 41 carrying the recording head 40 is slidably movable along the pair of guide rails 45, 46. As long as the pair of guide rails 45, 46 are held in parallel to each other, the carriage 41 can be smoothly movable along the guide rails 45, 46 precisely in parallel to a predetermined direction. However, if the body 32 of the upper unit 16 suffers from distortion, for example, if one of the box portions 67, 68 is displaced relative to the other of the box portions 67, 68, the parallelism between the guide rails 45, 46 would be lost so that the carriage 41 could not be smoothly movable along the guide rails 45, 46 precisely in parallel to the predetermined direction, thereby causing a risk of reduction of quality of image recorded on each recording sheet. Such a risk can be eliminated owing to the above-described construction effective to maintain the positional accuracy of each component of the apparatus 10.

As described above, the supplying device is provided in the body 31 of the lower unit 15 while the drive source is provided in the body 32 of the upper unit 16. More specifically, the above-described motor M, drive gear DG and interconnecting gear G1 are held by the body 32 of the upper unit 16, while the above-described sheet supplying roller 35, five gears and driven gear are held by the body 31 of the lower unit 15 (see FIG. 2). As long as a positional relationship between the supplying device and the drive source is maintained, namely, as long as the interconnecting gear G1 suitably meshes with a certain one (that is coaxial with the shaft 37) of the five gears, the drive force is satisfactorily transmitted from the drive source to the supplying device. However, if the positional relationship were changed by such a degree that affects the suitable meshing engagement between the gears, the drive force would not be transmitted from the drive source to the supplying device, thereby disenabling the recording sheet to be supplied from the first sheet supplying cassette 21 toward the conveying paths 17, 19.

What is claimed is:

1. An image recording apparatus comprising:

a conveying device configured to convey sheets supplied from first and second sheet holders, in a conveying direction along a conveying path; and first and second bodies that are removably connected to each other such that said second body is disposed on an upper side of said first body, wherein said first body includes (i-a) a pair of first box portions which are opposed to each other in an opposed direction and which cooperate with each other to define a first space therebetween, such that said first sheet holder can be accommodated in said first space, (i-b) a first connector interconnecting said pair of first box portions, (i-c) at least one first foot portion provided on a bottom surface of each of said first box portions so as to be in contact with an installed surface on which said image recording apparatus is to be installed, and (i-d) at least one first support portion extending upwardly from said at least one first foot portion, and wherein said second body includes (ii-a) a pair of second box portions which are mounted on said pair of first box portions, respectively, said pair of second box portions being opposed to each other in said opposed direction and cooperating with each other to define a second space therebetween, such that said second sheet holder can be accommodated in said second space, (ii-b) a second connector interconnecting said pair of second box portions, and (ii-c) at least one second foot portion provided on a bottom surface of each of said second box portions, said at least one second foot portion being located in a position aligned with said at least one first support portion, so as to be in contact with a distal end of said at least one first support portion, said image recording apparatus further comprising a frame member extending in said opposed direction and bridging between said pair of second box portions, wherein said conveying device is held by said frame member.

2. The image recording apparatus according to claim 1, wherein said at least one first foot portion consists of at least three first foot portions provided on said bottom surface of each of said first box portions so as to be in contact with the installed surface, wherein said at least one first support portion consists of at least three first support portions each extending upwardly from a corresponding one of said at least three first foot portions, and wherein said at least one second foot portion consists of at least three second foot portions provided on said bottom surface of each of said second box portions, each of said at least three second foot portions being located in a position aligned with a corresponding one of said at least three first support portions, so as to be in contact with a distal end of the corresponding one of said at least three first support portions.

3. The image recording apparatus according to claim 1, wherein said conveying device includes first and second rollers disposed in said conveying path, wherein said first roller is configured to convey the sheets along said conveying path, while said second roller is located on a downstream side of said first roller in said conveying direction and configured to discharge the sheets from said conveying path onto said second sheet holder, and wherein said first and second rollers are rotatable about respective axes which are parallel to each other and which are spaced apart from each other in said conveying direction that is perpendicular to said opposed direction.

4. The image recording apparatus according to claim 3, further comprising:

a pair of guides which extend in said opposed direction and which are parallel to each other; and a recording device disposed between said first and second rollers in said conveying direction and configured to record an image on the sheets that are conveyed along said conveying path, said recording device being slidably guided by said guides, wherein said guides and said recording device are provided in said frame member.

5. The image recording apparatus according to claim 1, further comprising a supplying device that is to be driven by a drive force transmitted from a drive source so as to supply the sheets from said first sheet holder, toward said conveying path, wherein said supplying device is provided in said first body while said drive source is provided in said second body.

6. The image recording apparatus according to claim 1, wherein each of said first and second bodies is provided by a single piece that is made of resin.

7. The image recording apparatus according to claim 1, wherein each of said first and second bodies has width and depth dimensions as measured in width and depth directions of said image recording apparatus, respectively, one of which is parallel to said opposed direction, and wherein each of said first and second bodies has a height dimension as measured in a vertical direction of said image recording apparatus, such that said height dimension is smaller than said width and depth dimensions.

8. The image recording apparatus according to claim 1, wherein said at least one first support portion includes a column provided inside said first box portions.

9. The image recording apparatus according to claim 8, wherein said column is contiguous to a rib that is provided inside said first box portions.

10. The image recording apparatus according to claim 1, wherein said second body further includes (ii-d) at least one second support portion extending upwardly from of said at least one second foot portion.

11. The image recording apparatus according to claim 1, further comprising an elastic member that is to be detachably attached to said at least one second foot portion in a state in which said first body is removed from said second body for use of said image recording apparatus without said first body, such that said at least one second foot portion is in contact with the installed surface via said elastic member.

12. The image recording apparatus according to claim 2, wherein said at least three first support portions comprise at least three columns provided inside each of said first box portions, and wherein each of said at least three columns extends upwardly from a corresponding one of said at least three first foot portions, and has a distal end at which each of said at least three columns is in contact with a corresponding one of said at least three second foot portions that is located in a position aligned with said each of said at least three columns.

13. The image recording apparatus according to claim 1, wherein said conveying device is configured to convey the sheets in said conveying direction that is perpendicular to said opposed direction in which said first box portions are opposed to each other and in which said second box portions are opposed to each other.

14. The image recording apparatus according to claim 2, wherein said at least three first foot portions protrude downwardly from said bottom surface of each of said first box portions, and wherein said at least three second foot portions protrude downwardly from said bottom surface of each of said second box portions.

* * * * *